US011424555B2

(12) United States Patent
Winebrand et al.

(10) Patent No.: US 11,424,555 B2
(45) Date of Patent: Aug. 23, 2022

(54) REFLECTOR ANTENNA WITH MINIMAL FOCAL DISTANCE AND LOW CROSS-POLARIZATION

(71) Applicant: Lockheed Martin Corporation, Bethesda, MD (US)

(72) Inventors: Mark Winebrand, Littleton, CO (US); Jason Stewart Wrigley, Littleton, CO (US)

(73) Assignee: LOCKHEED MARTIN CORPORATION, Bethesda, MD (US)

( * ) Notice: Subject to any disclaimer, the term of this patent is extended or adjusted under 35 U.S.C. 154(b) by 75 days.

(21) Appl. No.: 17/074,411

(22) Filed: Oct. 19, 2020

(65) Prior Publication Data

US 2021/0119351 A1 Apr. 22, 2021

Related U.S. Application Data

(60) Provisional application No. 62/923,387, filed on Oct. 18, 2019.

(51) Int. Cl.

| | |
|---|---|
| ***H01Q 25/00*** | (2006.01) |
| ***H01P 5/18*** | (2006.01) |
| ***H01Q 21/00*** | (2006.01) |
| ***H01Q 19/10*** | (2006.01) |
| ***H01P 1/161*** | (2006.01) |
| *H01Q 15/16* | (2006.01) |

(52) U.S. Cl.

CPC ..... *H01Q 25/001* (2013.01); *H01P 1/161* (2013.01); *H01P 5/182* (2013.01); *H01Q 19/10* (2013.01); *H01Q 21/0037* (2013.01); *H01Q 15/16* (2013.01)

(58) Field of Classification Search

CPC ..... H01Q 25/001; H01Q 19/10; H01Q 21/0037; H01Q 15/16; H01P 5/182; H01P 1/027

See application file for complete search history.

(56) References Cited

U.S. PATENT DOCUMENTS

| | | | | |
|---|---|---|---|---|
| 4,998,113 | A * | 3/1991 | Raghavan | H01Q 5/47 333/135 |
| 5,612,702 | A * | 3/1997 | Kinsey | G01S 13/4409 342/149 |
| 6,650,291 | B1 * | 11/2003 | West | H01Q 5/40 342/371 |
| 7,098,859 | B2 * | 8/2006 | Shimawaki | H01P 1/161 343/705 |
| 8,537,067 | B2 * | 9/2013 | Tahmisian, Jr. | H01Q 13/02 343/786 |
| 2002/0167442 | A1 * | 11/2002 | Taylor | G01S 19/14 342/357.64 |
| 2017/0207528 | A1 * | 7/2017 | Lundstedt | H01Q 15/16 |

OTHER PUBLICATIONS

Dual-Polarized Antenna with Orthomode Transducer for 60 GHz Communications—Zunnurain Ahmad et al. Date Unknown.*

* cited by examiner

*Primary Examiner* — Vibol Tan
(74) *Attorney, Agent, or Firm* — BakerHostetler

(57) ABSTRACT

A reflector antenna includes a reflector, a feed, and a beamforming network. The feed is spaced apart at a focal distance from the reflector. The feed includes an array of dual linear polarized elements. The beamforming network is operatively coupled to the feed. The beamforming network is configured to generate a Sigma pattern and a Delta pattern in a plane orthogonal to the reflector plane of symmetry.

19 Claims, 16 Drawing Sheets

REFLECTOR ANTENNA WITH MINIMAL FOCAL DISTANCE AND LOW CROSS-POLARIZATION

CROSS-REFERENCES TO RELATED APPLICATIONS

This application claims priority to U.S. Provisional Patent Application No. 62/923,387 filed Oct. 18, 2019, and the entire contents of this document being incorporated herein by this reference.

STATEMENT REGARDING FEDERALLY SPONSORED RESEARCH OR DEVELOPMENT

Not applicable.

BACKGROUND

Field

The present description relates in general to reflector antennas, and more particularly to, for example, without limitation, single offset reflector antennas with a short focal distance and with an array of dual linear polarized elements.

Description of the Related Art

The description provided in the background section should not be assumed to be prior art merely because it is mentioned in or associated with the background section. The background section may include information that describes one or more aspects of the subject technology.

Single offset reflector antennas can be used to send and receive radio frequency signals. During operation, fields from the antenna may experience cross-polarization. Cross-polarization may arise due to offset geometry of the parabolic reflector antenna. In some applications, the amount of cross-polarization may grow with a larger feed offset angle. Further, in some applications, the amount of cross-polarization may grow with a shorter focal distance or smaller ratio between the focal distance and the diameter of the reflector of the antenna.

It would be advantageous to reduce the cross-polarization of fields from the antenna. Further, in some applications, it would be desirable to reduce the volume, the size, and/or the mass of the antenna. Further it would be advantageous to provide a more flexible antenna design that is able to fit in a constrained environment, for example space applications, without scarifying the antenna performance.

SUMMARY

The subject technology is illustrated, for example, according to various aspects described below.

According to some embodiments a reflector antenna includes an offset portion of parabolic reflector having a reflector plane of symmetry; a feed spaced apart at a focal distance from the reflector, the feed comprising an array of dual linear polarized elements; and a beamforming network operatively coupled to the feed and configured to generate the Sigma patterns and the Delta patterns in a plane orthogonal to the reflector plane of symmetry for two linear orthogonal polarizations.

In some applications, the reflector has a diameter and a ratio of the focal distance to the diameter is less than 0.55.

Further, the beamforming network can be configured to generate the Sigma pattern and the Delta pattern in two linear orthogonal polarizations.

In some applications, the Delta pattern is excited by power decoupled from the Sigma pattern. Further, the Delta pattern can be normalized to a cross-polarization of the Sigma pattern in far field zone of the radiated pattern. The Delta pattern can be out of phase to the cross-polarization of the Sigma pattern. Further, the Delta pattern can out of phase to the cross-polarization of the Sigma pattern across at least 50% of a bandwidth of the reflector antenna.

In some applications, once the Delta is normalized to and out of phase to the cross-polarization of the Sigma pattern the resulting cross polarization in the far field zone of the antenna may be cancelled or effectively reduced.

In some applications, once the Delta is normalized to and out of phase to the cross-polarization of the Sigma pattern the resulting cross polarization in the far field of the antenna may be cancelled or significantly for two orthogonal linear polarizations.

In some applications, the Delta pattern is excited by power decoupled from the Sigma pattern. The decoupled power amplitude and phase is chosen to minimize the resulting cross-polarization, cross-polarization discrimination or some relevant criteria, and remains constant across at least 50% of a bandwidth.

In some applications, the array of dual linear polarized elements each comprise an orthomode transducer. The orthomode transducer can be asymmetric.

Optionally, the array of dual linear polarized elements each comprise an open ended waveguide. Further, the waveguide can be tapered. In some embodiments, the open-ended waveguide has a square cross-sectional shape to equally generate two linear polarized signals.

According to some embodiments a feed for use with a reflector antenna includes an array of dual linear polarized orthomode transducers, wherein each dual linear polarized orthomode transducer is coupled to an open-ended waveguide. Further, the open-ended waveguide can be tapered. In some embodiments, the open-ended waveguide has a square cross-sectional shape.

According to some embodiments a reflector antenna includes an offset portion of parabolic reflector; and an array of dual linear polarized open-ended waveguides with orthomode transducers spaced apart from the reflector, wherein each dual linear polarized orthomode transducer is coupled to an open ended waveguide.

In some applications, the reflector has a diameter and a ratio of the focal distance to the diameter is less than 0.55.

Further, the open ended waveguide can be tapered. In some embodiments, the open ended waveguide has a square cross-sectional shape.

In some applications, the reflector antenna further includes a beamforming network operatively coupled to the array of dual linear polarized orthomode transducers and configured to generate a Sigma pattern and a Delta pattern in a plane orthogonal to a reflector plane of symmetry for two orthogonal linear polarizations.

In the following description, specific embodiments are described to shown by way of illustration how the invention may be practiced. It is to be understood that other embodiments may be utilized, and changes may be made without departing from the scope of the present invention.

According to some embodiments the feed array may be configured as a 2×2 array of any broadband dual linear polarized radiating elements, such as circular or square open-ended waveguides, cross electric dipoles, disc rod antennas, etc.

According to some embodiments the feed array element can include two orthomode transducers coupled to square open-ended tapered waveguides.

BRIEF DESCRIPTION OF THE DRAWINGS

FIGS. 8 and 9 are charts illustrating the co-polarization and cross-polarization of the Sigma pattern after cross-polarization cancellation FIG. 10 illustrate a reflector antenna optics, according to some embodiments of the present disclosure.

DETAILED DESCRIPTION

Figure 1:
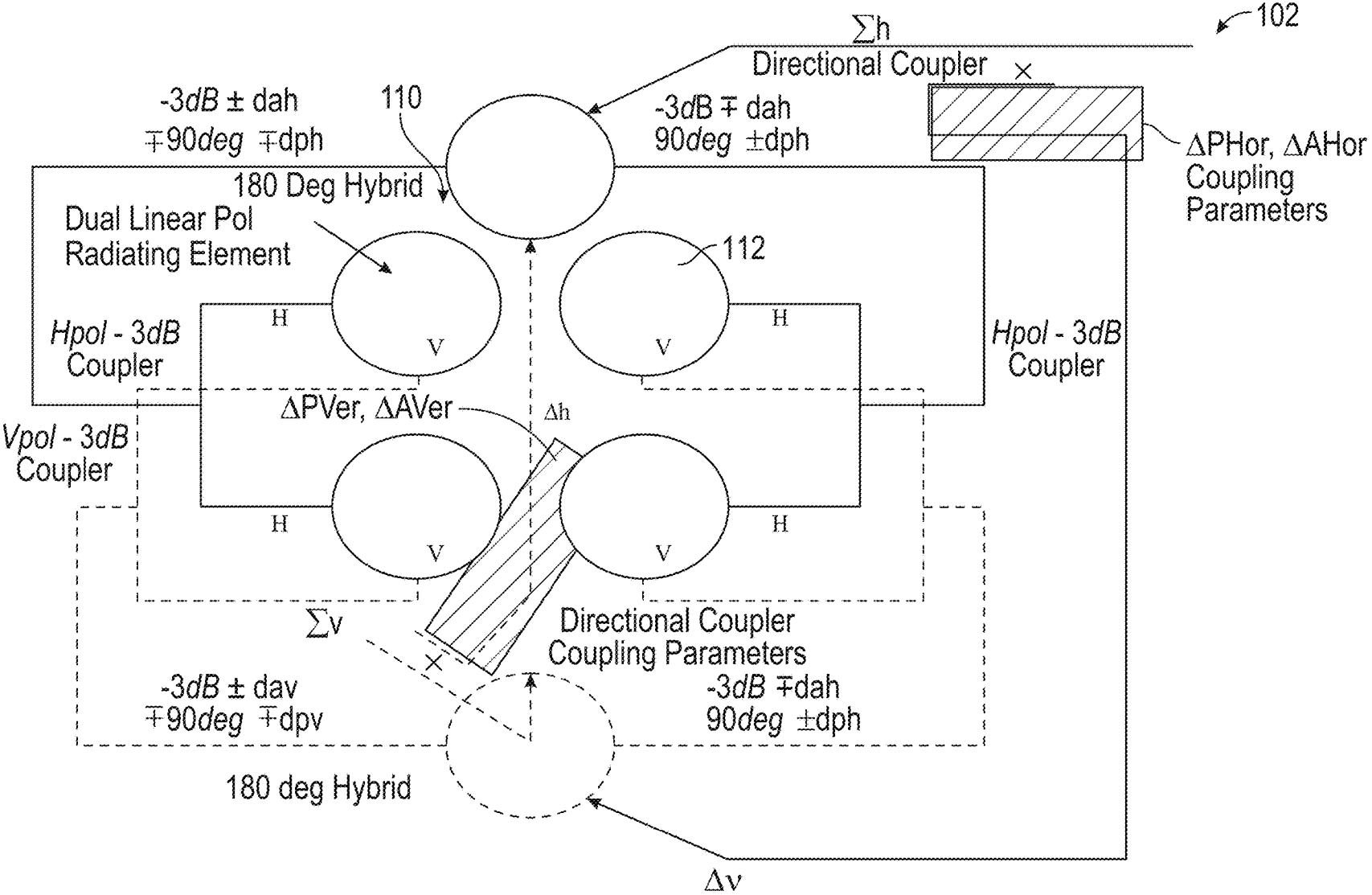
FIG. 1 is a schematic of a beam forming network, according to some embodiments of the present disclosure.

As described herein, reflector antennas can be used to send and receive radio frequency signals. Conventional offset reflector antennas can utilize various approaches to minimize cross-polarization of fields.

In some applications, certain conventional offset reflector antennas can utilize a feed array with a large number of elements, a shaped reflector designed to cancel cross-polarization, and/or a polarization selective grip disposed between the feed and the reflector. In some applications, a conventional offset reflector antenna can utilize a conjugated feed wherein cross-polarization contributed by the offset geometry in the feed focal plane is similar to a combination of the higher order modes.

Alternatively, in some applications, certain conventional offset reflector antennas can utilize a long focal distance offset reflector design to reduce cross-polarization (on the order of approximately 30 dB). For example, a Ku-band offset reflector antenna can have a diameter of 100 inches, a focal length of 140 inches, a focal length to diameter ratio of 1.4 and an offset of 20 inches. The feed of the Ku-band offset reflector antenna can be a corrugated horn feed with a feed aperture radius of 3.3 inches. The feed can include four ports that are used, including transmission (horizontal polarization), transmission (vertical polarization), receiving (horizontal polarization), and receiving (vertical polarization). The feed offset angle can be approximately 27 degrees and the reflector illumination cone can be approximately +/−19.2 degrees. The waveguide run can be approximately 200-300 inches.

In another example, a C-band offset reflector antenna can have a diameter of 100 inches, a focal length of 140 inches, a focal length to diameter ratio of 1.4 and an offset of 30 inches. The feed of the C-band offset reflector antenna can be a corrugated horn feed with a feed aperture radius of 7.5 inches and a length of approximately 30 inches. The feed can include four ports that are used, including transmission (horizontal polarization), transmission (vertical polarization), receiving (horizontal polarization), and receiving (vertical polarization). The feed offset angle can be approximately 30 degrees and the reflector illumination cone can be approximately +/−19.2 degrees. The waveguide run can be approximately 200-300 inches.

The approaches described in above offset reflector antennas can be large in size, heavy, expensive, and may not suitable to size and weight sensitive applications, such as space satellite applications.

Therefore, it is desirable to reduce the size (a focal length to diameter ratio of approximately less than 0.55), weight, and cost of the antenna without degrading the performance of the antenna, for example in cross polarization. Further, in some applications, it is desirable to reduce or eliminate cross-polarization across a wide bandwidth.

As appreciated by the present disclosure, embodiments of the reflector antenna disclosed herein include features to reduce or eliminate cross-polarization while reducing the size weight and cost of the antenna. Various aspects of the present disclosure provide an antenna with a reduced focal length to diameter ratio compared to conventional offset reflector antennas (a focal length to diameter ratio of approximately less than 0.55). Further, various aspects of the present disclosure provide antenna that allows for a reduction or elimination of cross-polarization across a wide bandwidth (in excess of 50%).

The present description relates in general reflector antennas, and more particularly to, for example, without limitation, reflector antennas with an array of dual linear polarized elements.

Figure 2:
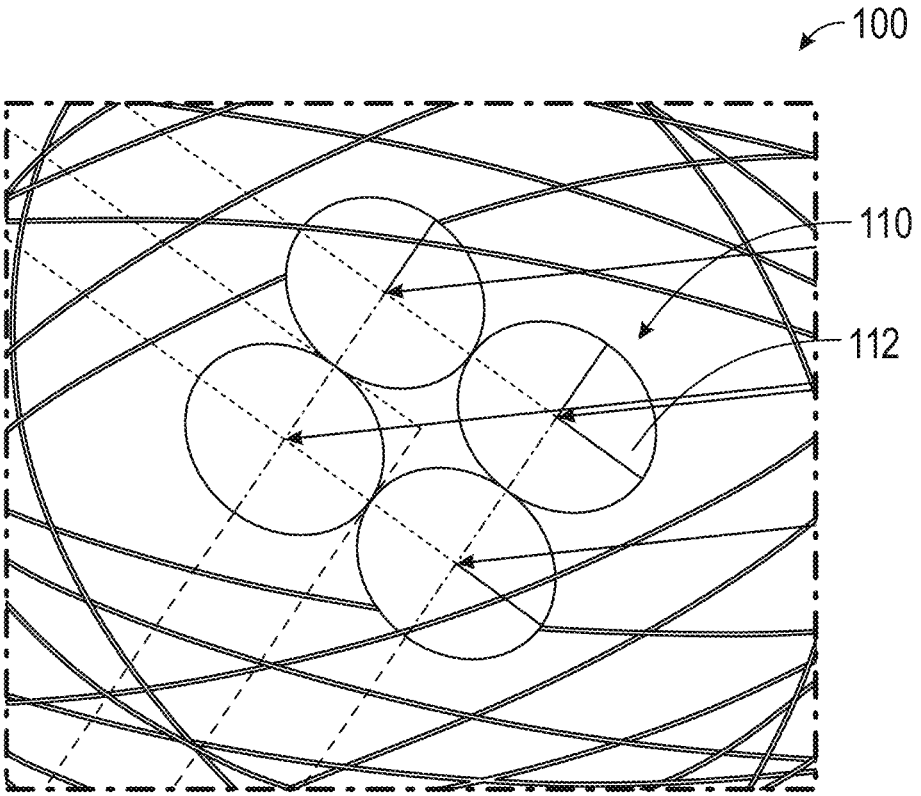
FIGS. 2 and 3 illustrate a feed array and a reflector antenna, according to some embodiments of the present disclosure.
Figure 3:
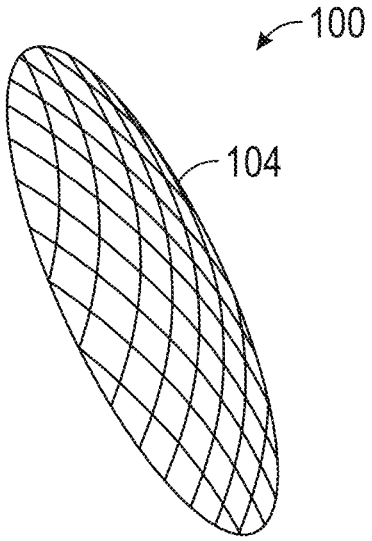

FIG. 1 is a schematic of a beam forming network, according to some embodiments of the present disclosure. FIGS. 2 and 3 illustrate a feed array and a reflector antenna, according to some embodiments of the present disclosure. With reference to FIGS. 1-3, the reflector antenna 100 can minimize or eliminate cross-polarization across a wide bandwidth while providing a short focal length to diameter ratio (less than 0.55).

In the depicted example, the reflector antenna 100 includes a feed 110 formed from an array of dual linear polarized elements 112. As illustrated, the dual linear polarized elements 112 can be arranged in a 2×2 array to form the feed 110. The dual linear polarized elements 112 can include an open-ended waveguide or any other suitable waveguide or other type of antennas.

Advantageously, as described herein, the feed 110 can be disposed a short focal distance (focal length to diameter ratio less than 0.55) from the reflector 104. As can be appreciated, the feed array aperture of the feed 110 can be 5-6 times smaller than in conventional applications and the length of the array element of the feed 110 could be approximately 8-10 times shorter than in conventional applications. As can be appreciated, conventional applications may utilize a long reflector focal distance and a corrugated horn as a feed.

In the depicted example, the beamforming network 102, as illustrated in FIG. 1, is operably coupled to the feed 110 to generate Sigma and Delta patterns. The beamforming network 102 generates Sigma and Delta patterns in a plane orthogonal to the plane of symmetry of the parabolic reflector 104. In the depicted example, the Sigma and Delta patterns are generated in two orthogonal polarizations. The Delta patterns are excited by a relatively small portion of power decoupled from the orthogonal Sigma patterns.

In some applications, the decoupling factors are configured such that a far field Delta pattern would be normalized and opposite to the cross-polarization of the Sigma pattern, allowing the cross-polarization to be canceled or at least significantly reduced. As can be appreciated, the decoupling factors can be configured to minimize either the cross-polarization of the Sigma pattern, cross-polarization discrimination, and/or left hand circular polarization/right hand circular polarization squint in circular polarized applications and across a wide frequency band. While delivering these features, the decoupling factors can be configured to be constant across a considered bandwidth.

As can be appreciated, the portion of power decoupled from the Sigma channel does not reduce the peak gain of the reflector antenna 100. During operation, once the Delta pattern cancels out the cross-polarization in far field, the cross polarization of the Delta pattern is in phase with the Sigma pattern, recovering the decoupled portion of the power back to the pattern peak, across a wide frequency range.

Advantageously, the configuration of the reflector antenna 100 described herein allows for low cross polarization (greater than 28 dB) in at least 50% of the considered bandwidth with constant decoupling factors.

For example, a reflector antenna in accordance with embodiment described herein can be a Ku-band (10.7 GHz-14.7 GHz) offset reflector antenna. The example antenna can have a circular dual linear polarized open waveguide radiating element with an aperture diameter of 0.375 inches. The feed can be a 2×2 array fed by a beamforming network. The reflector can have a diameter of 100 inches, a focal length of 55 inches, a focal length to diameter ratio of 0.55, and an offset of 37.5 inches. The feed offset angle can be approximately 70 degrees. As can be appreciated, the coupling parameters or factors (ΔPHor, ΔAHor, ΔPver, ΔAver) can be configured to minimize cross polarization in far field.

Figure 4:
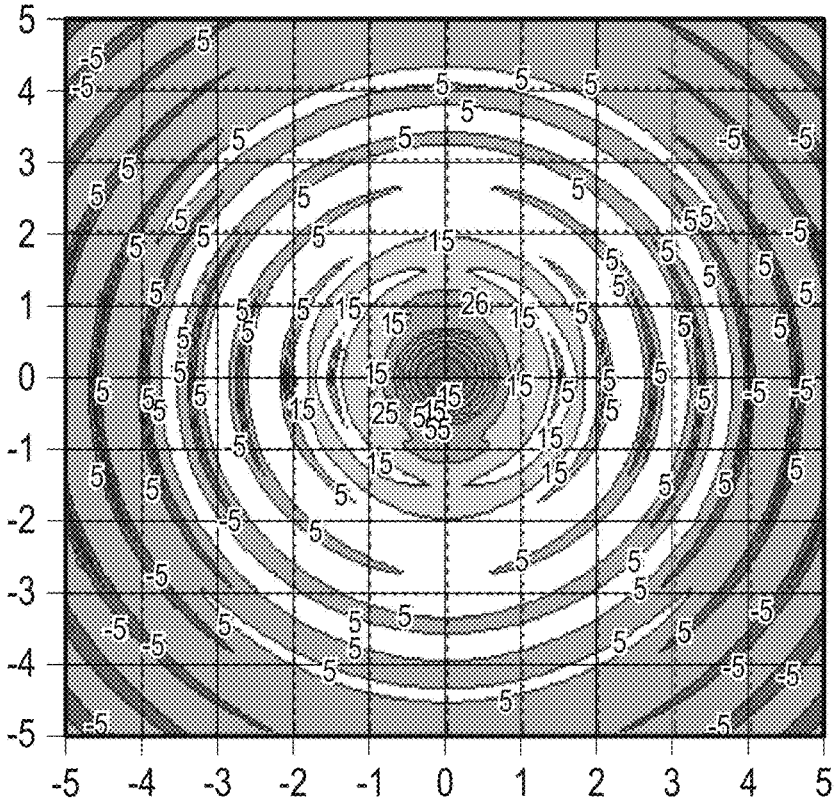
FIGS. 4-9 are charts illustrating the co-polarization and cross-polarization of a short focal distance single offset parabolic reflector antenna Sigma and Delta far-field patterns, according to some embodiments of the present disclosure.
Figure 5:
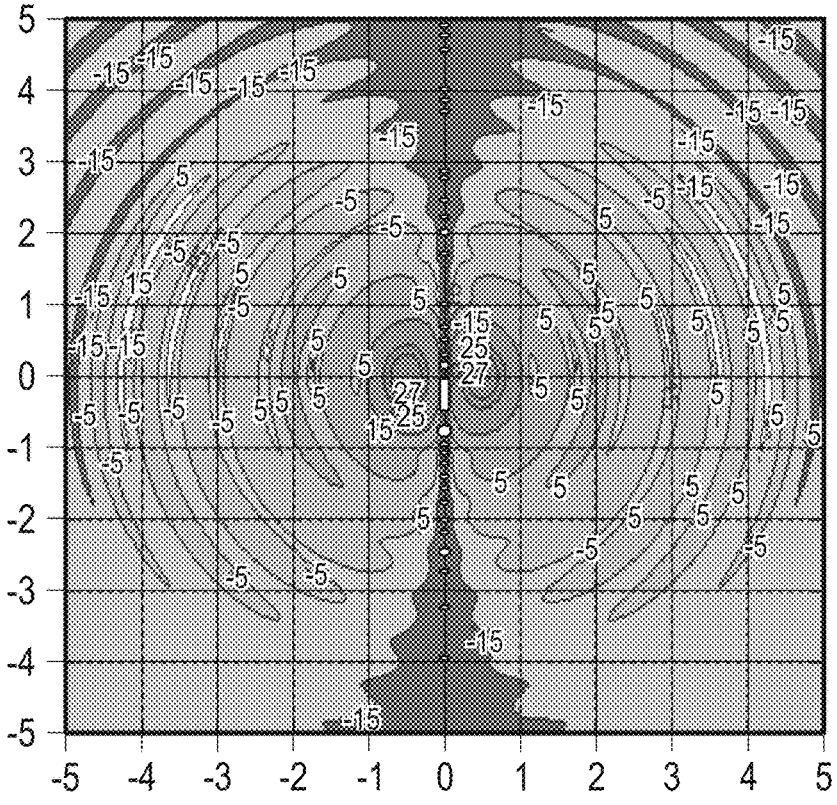
Figure 6:
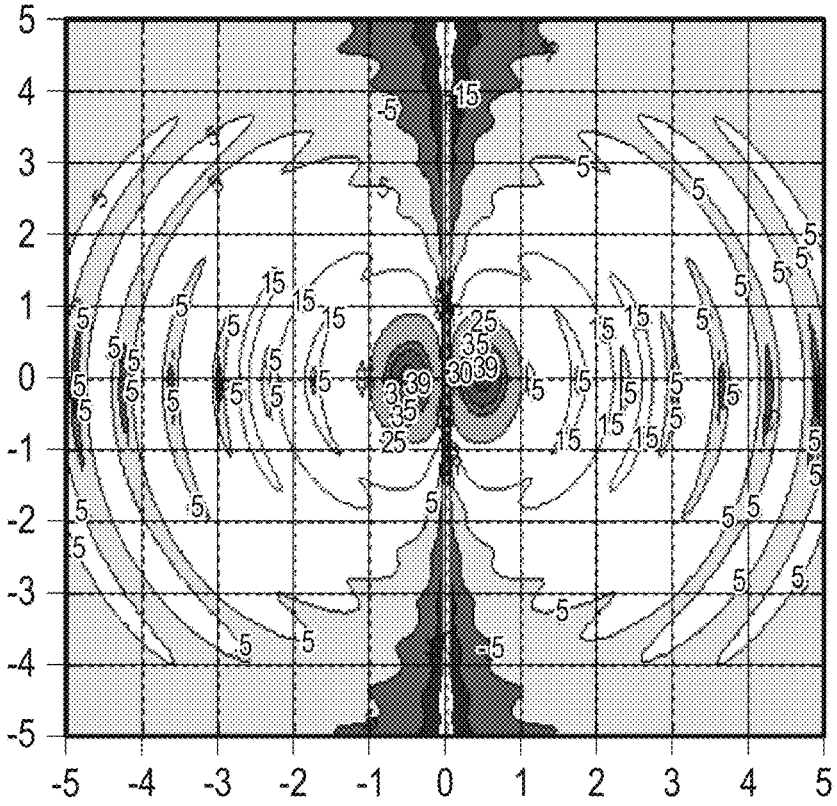
Figure 7:
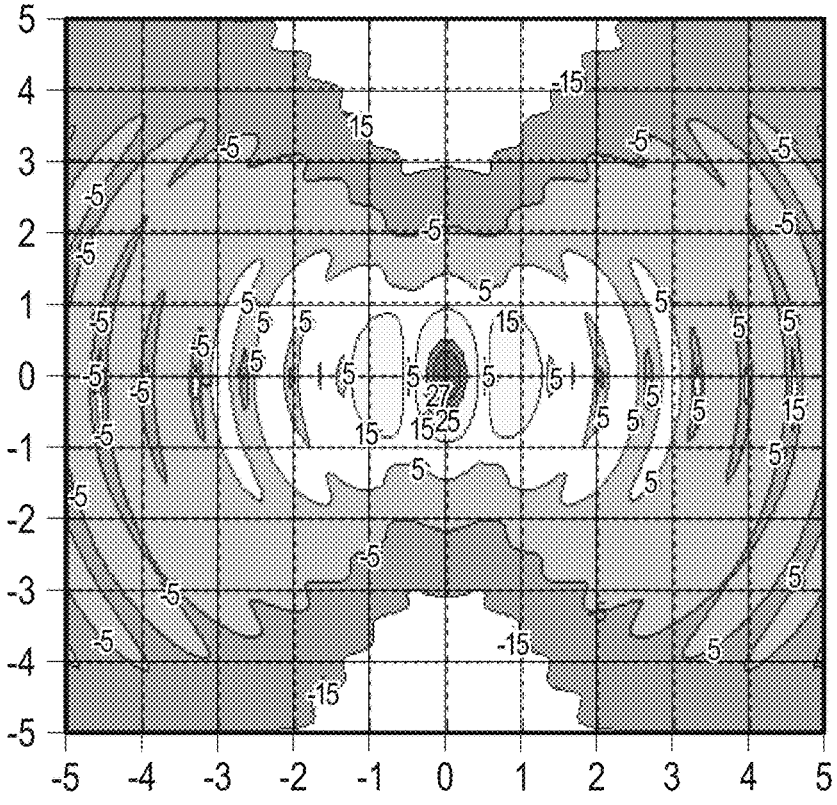

FIG. 4 illustrates an example of the co-polarization performance of an embodiment of the reflector antenna at 10.7 GHz (horizontal polarization) with uncompensated feeding. FIG. 5 illustrates an example of the cross-polarization of the horizontal polarization by an embodiment of the reflector antenna at 10.7 GHz (vertical polarization) with uncompensated feeding. FIG. 6 illustrates an example of the co-polarization difference pattern of an embodiment of the reflector antenna at 10.7 GHz (vertical polarization) with uncompensated feeding. FIG. 7 illustrates an example of the cross polarization difference pattern of an embodiment of the reflector antenna at 10.7 GHz (horizontal polarization) with uncompensated feeding.

Figure 8:
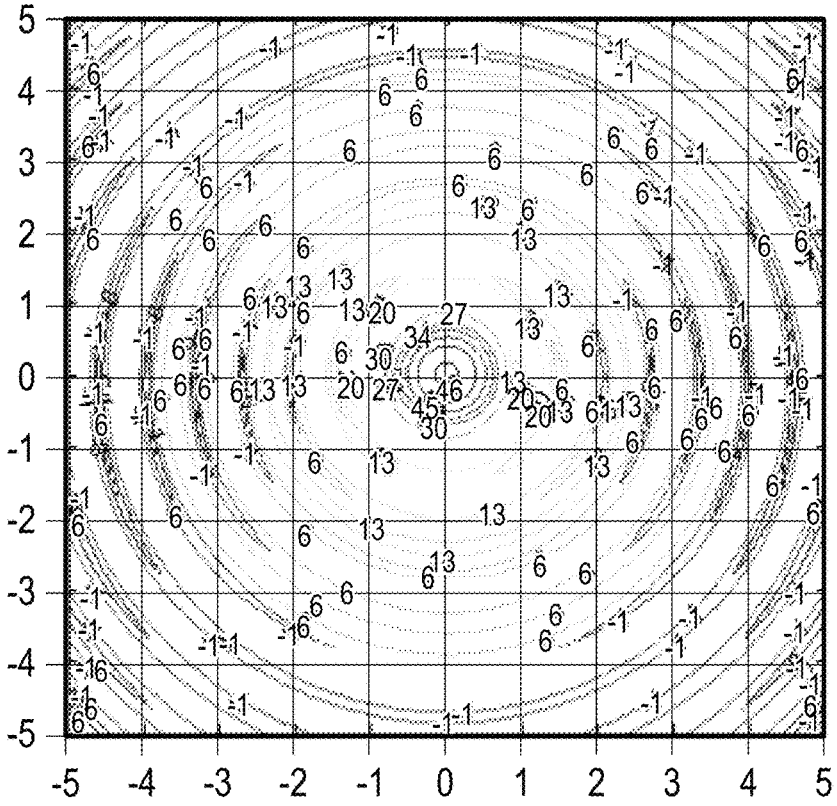
Figure 9:
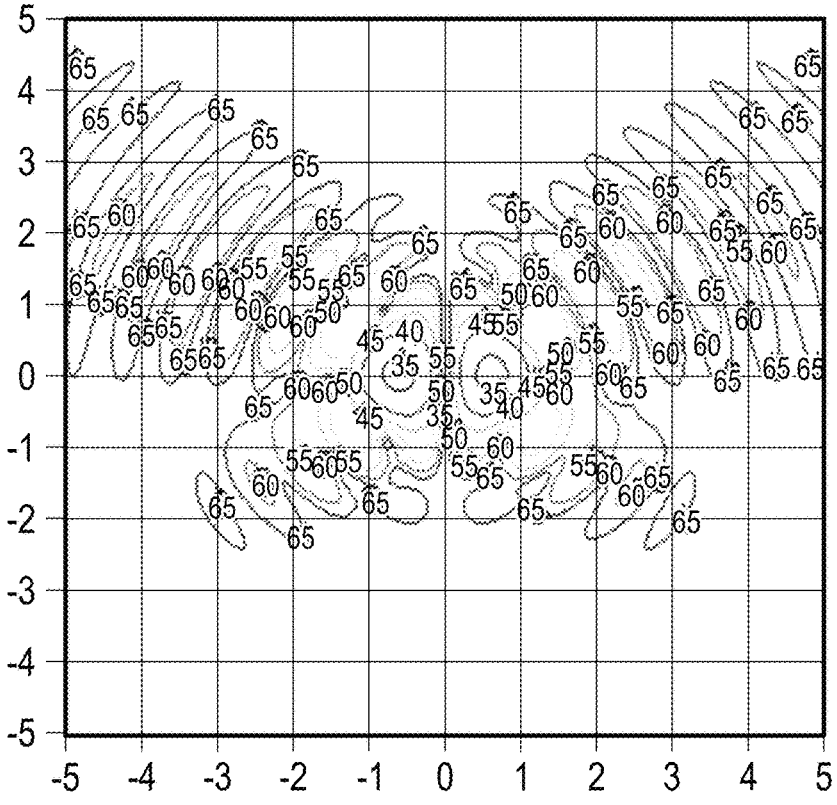

FIG. 8 illustrates an example of the co-polarization performance of an embodiment of the reflector antenna at 10.7 GHz (horizontal polarization) with compensated feeding. FIG. 9 illustrates an example of the cross-polarization performance by an embodiment of the reflector antenna at 10.7 GHz (vertical polarization) with compensated feeding. As illustrated, and shown in the tables below, embodiments of the reflector antenna allow for improved cross polarization performance across a wide frequency band.

| 10.7 GHz to 12.75 GHz | | | | | | |
|---|---|---|---|---|---|---|
| Frequency GHz | Polar. | X-pol dB WC Uncompensated | X-pol dB WC Compensated | Co Pattern Peak dBi Uncompensated | Co Pattern Peak dBi Compensated | Peak Difference |
| 10.7 | H | 17.79 | 33.87 | 46.53 | 46.55 | 0.02 |
| 11.7 | H | 18.09 | 37.49 | 47.16 | 47.21 | 0.05 |
| 12.75 | H | 18.45 | 34.99 | 47.59 | 47.67 | 0.08 |
| 10.7 | V | 17.78 | 32.36 | 46.53 | 46.56 | 0.03 |
| 11.7 | V | 18.02 | 36.92 | 47.16 | 47.22 | 0.06 |
| 12.75 | V | 18.33 | 33.48 | 47.59 | 47.68 | 0.09 |

| Coupling at 10.7 GHz to 12.75 GHz | | |
|---|---|---|
| | dB | Deg |
| H-pol | −12.51 | 89.9 |
| V-pol | −12.85 | −89.9 |

| 13.5 GHz to 14.7 GHz | | | | | | |
|---|---|---|---|---|---|---|
| Frequency GHz | Polar. | X-pol dB WC Uncompensated | X-pol dB WC Compensated | Co Pattern Peak dBi Uncompensated | Co Pattern Peak dBi Compensated | Peak Difference |
| 13.5 | H | 18.74 | 32.53 | 47.78 | 47.92 | 0.14 |
| 14.2 | H | 19.02 | 31.77 | 47.9 | 48.05 | 0.15 |
| 14.7 | H | 19.25 | 30.9 | 47.94 | 48.1 | 0.16 |
| 13.5 | V | 18.6 | 32.63 | 47.79 | 47.92 | 0.13 |
| 14.2 | V | 18.85 | 31.82 | 47.9 | 48.05 | 0.15 |
| 14.7 | V | 19.07 | 30.9 | 47.94 | 48.1 | 0.16 |

| Coupling at 13.5 GHz to 14.7 GHz | | |
|---|---|---|
| | dB | Deg |
| H-pol | −15.39 | 89.9 |
| V-pol | −15.37 | −89.9 |

| 10.7 GHz to 14.7 GHz | | | | | | |
|---|---|---|---|---|---|---|
| Frequency GHz | Polar. | X-pol dB WC Uncompensated | X-pol dB WC Compensated | Co Pattern Peak dBi Uncompensated | Co Pattern Peak dBi Compensated | Peak Difference |
| 10.7 | H | 17.79 | 28.55 | 46.53 | 46.58 | 0.05 |
| 11.7 | H | 18.09 | 32.31 | 47.16 | 47.24 | 0.08 |
| 12.75 | H | 18.45 | 34.62 | 47.59 | 47.69 | 0.1 |
| 13.5 | H | 18.75 | 33.41 | 47.79 | 47.91 | 0.12 |
| 14.2 | H | 19.02 | 31.88 | 47.9 | 48.05 | 0.15 |
| 14.7 | H | 19.25 | 30.07 | 47.94 | 48.1 | 0.16 |
| 10.7 | V | 17.78 | 28.08 | 46.53 | 46.58 | 0.05 |
| 11.7 | V | 18.02 | 31.61 | 47.16 | 47.24 | 0.08 |
| 12.75 | V | 18.33 | 34.44 | 47.59 | 47.7 | 0.11 |
| 13.5 | V | 18.6 | 33.39 | 47.79 | 47.92 | 0.13 |
| 14.2 | V | 18.85 | 31.36 | 47.9 | 48.05 | 0.15 |
| 14.7 | V | 19.07 | 29.6 | 47.94 | 48.1 | 0.16 |

| Coupling at 10.7 GHz to 14.7 GHz | | |
|---|---|---|
| | dB | Deg |
| H-pol | −14.02 | 89.78 |
| V-pol | −14.21 | −89.78 |

In summary, for transmission bands only, cross-polarization is improved from 17.8 dB before compensation to up to 32.3 dB after compensation, while peak gain remains generally unchanged through the band or even increased by approximately 0.1 dB at high end of transmitting band. For receiving bands only, cross-polarization is improved from 18.6 dB before compensation to up to 30.9 dB after compensation, while peak gain is increased by more than 0.1 dB at the highest frequencies. For transmission and receiving bands combined, cross-polarization is improved from 17.8 dB before compensation to up to 28.1 dB after compensation, while peak gain is increased by about 0.05 dB at the lower end of the band and up to 0.15 dB at the higher end of the band. Advantageously, embodiments of the reflector antenna described herein do not increase insertion losses compared to conventional antennas. Further, in some applications, embodiments of the reflector antenna with shorter transmission lines (less than 100 inches) may have reduced insertion losses compared to conventional antennas.

Figure 10:
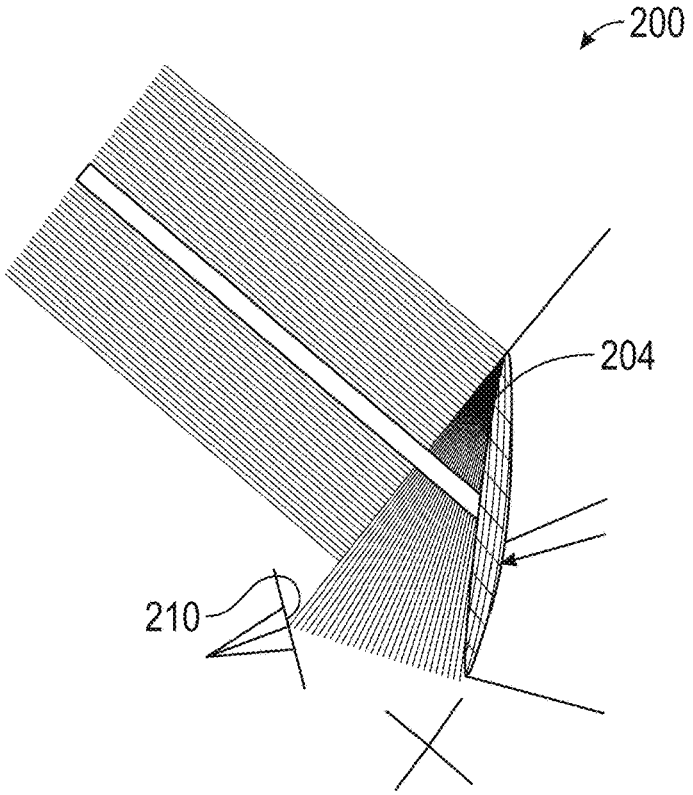
Figure 11:
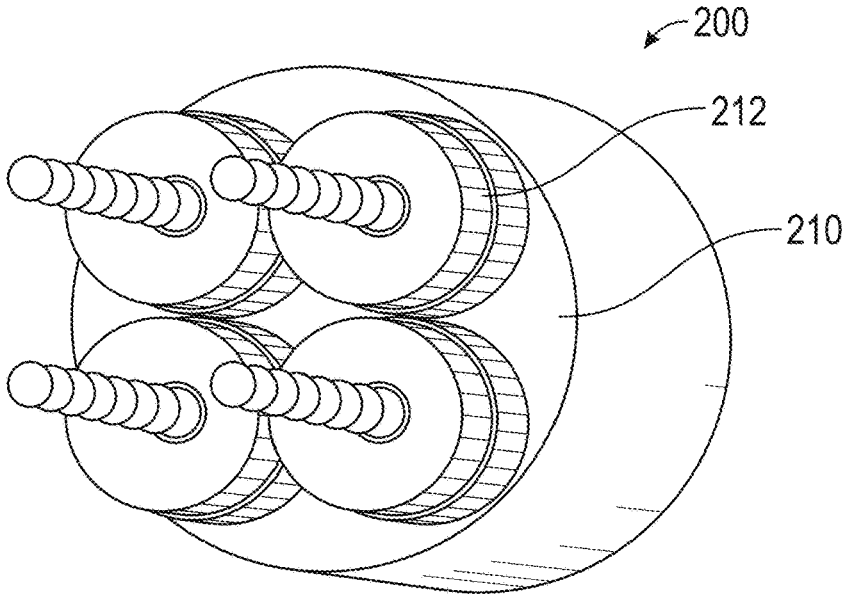
FIG. 11 illustrates a 2×2 antenna feed array including a disc rod antenna, according to some embodiments of the present disclosure.
Figure 12A:
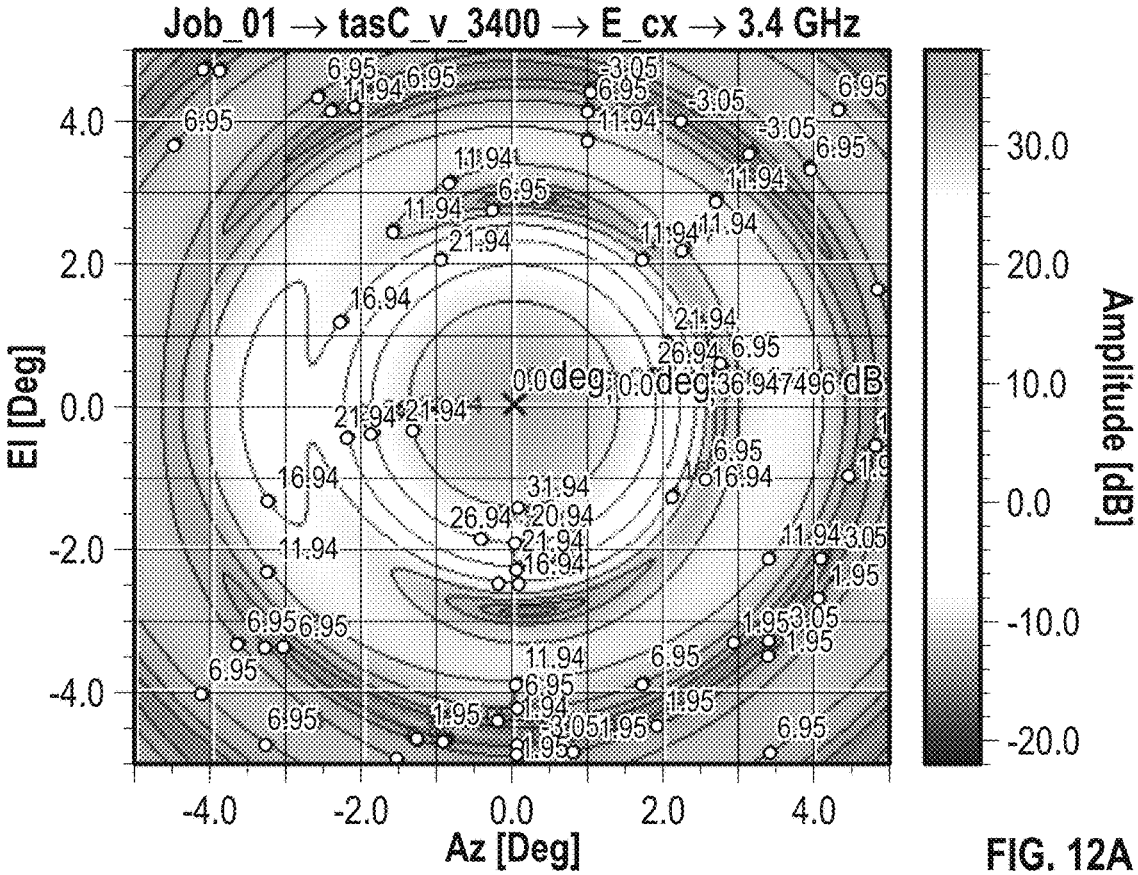
FIGS. 12A-D illustrate the C-band antenna performance illuminated by the 2×2 array illustrated in FIG. 11 before cross-polarization is compensated.
Figure 12B:
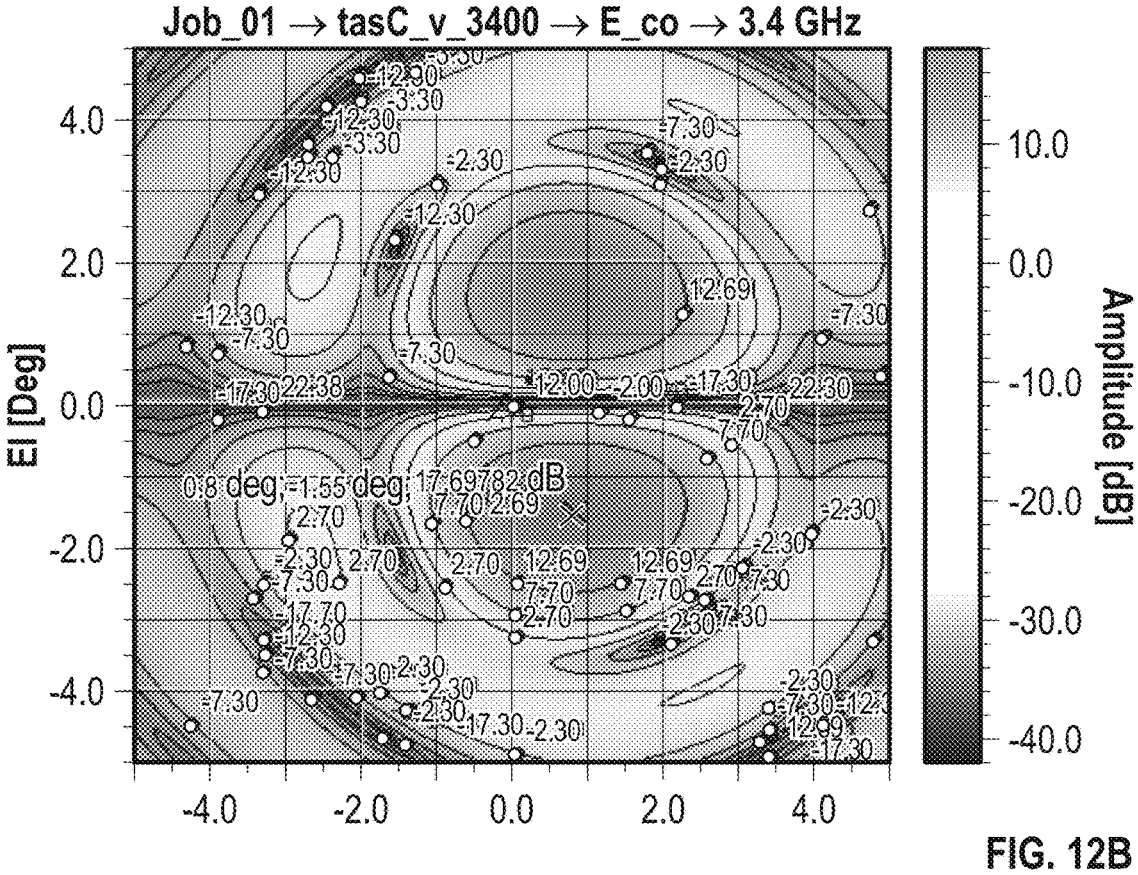
Figure 12C:
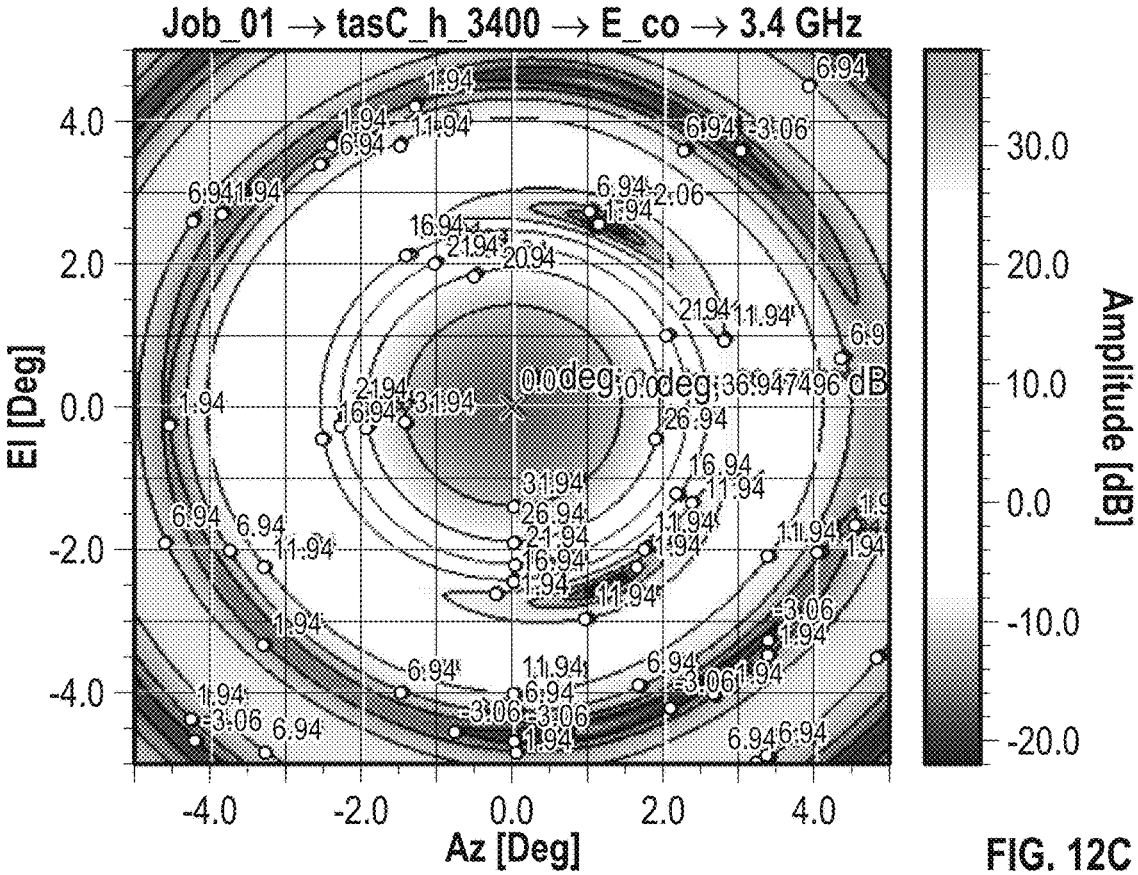
Figure 12D:
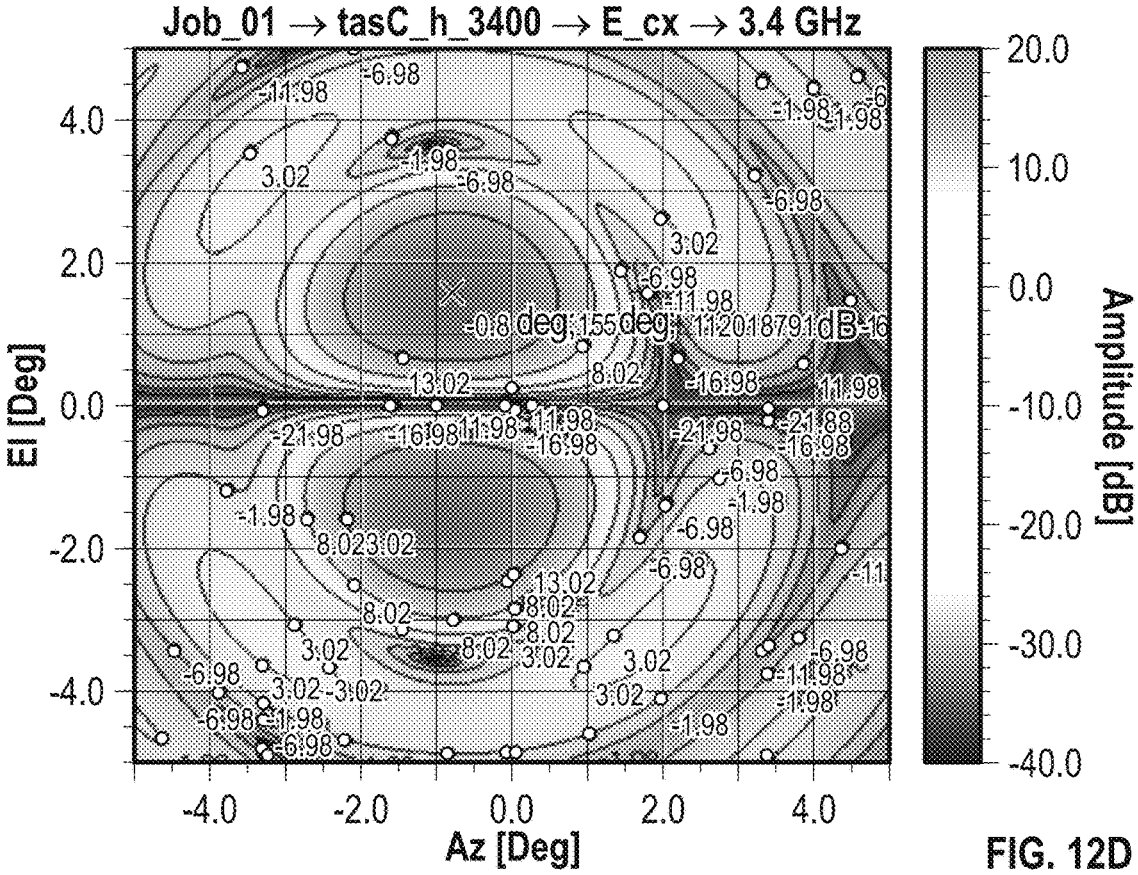

FIGS. 10 and 11 illustrate a reflector antenna 200, according to some embodiments of the present disclosure. In the depicted example, the reflector antenna 200 includes a feed 210 formed from an array of disc-rod dual linear polarized antennas 212. As illustrated, the disc-rod dual linear polarized antennas 212 can be arranged in a 2×2 array to form the feed 210.

In some embodiments, the reflector antenna 200 can be configured to be an extended C-band (3.4-3.65 GHz transmission, 6.425-6.675 receiving) offset reflector antenna. The example antenna can have a disc-rod dual linear polarized antenna radiating element with an aperture diameter of 1.12 inches and a height of 4.375 inches. The feed can be a 2×2 array with an aperture diameter of 2.64 inches. The reflector can have a diameter of 100 inches, a focal length of 70 inches, a focal length to diameter ratio of 0.7, and an offset of 30 inches. The feed offset angle can be approximately 55 degrees. As can be appreciated, the coupling parameters or factors (ΔPHor, ΔAHor, ΔPver, ΔAver) of the transmission and receiving bands can be configured to minimize cross polarization discrimination for regular and shaped reflection applications for regional low cross polarization discrimination shaped beams.

Figure 13:
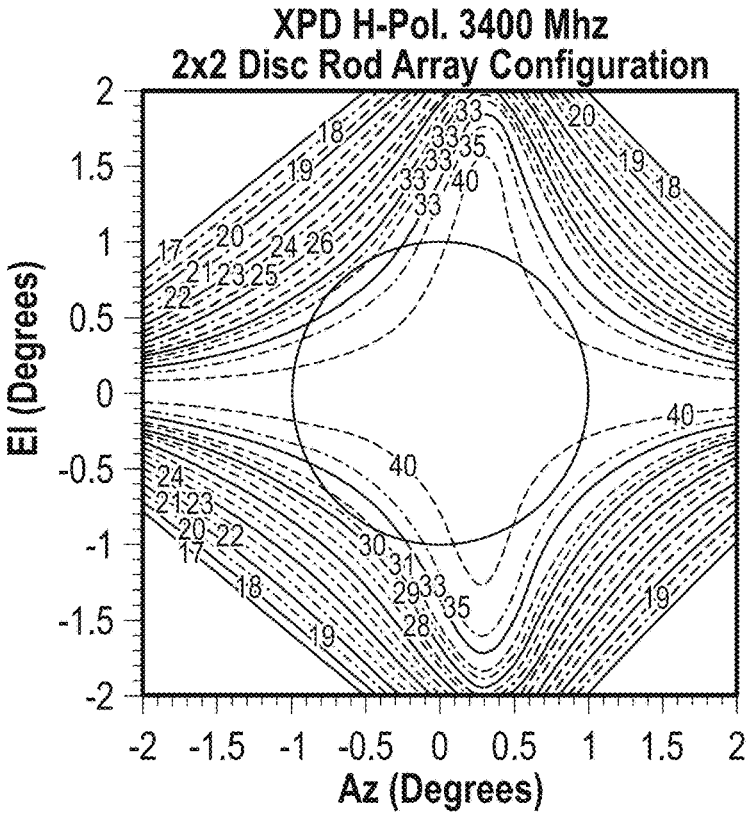
FIG. 13 illustrates cross polarization discrimination in the far field after cross-polarization compensation for horizontal linear polarization.
Figure 14:
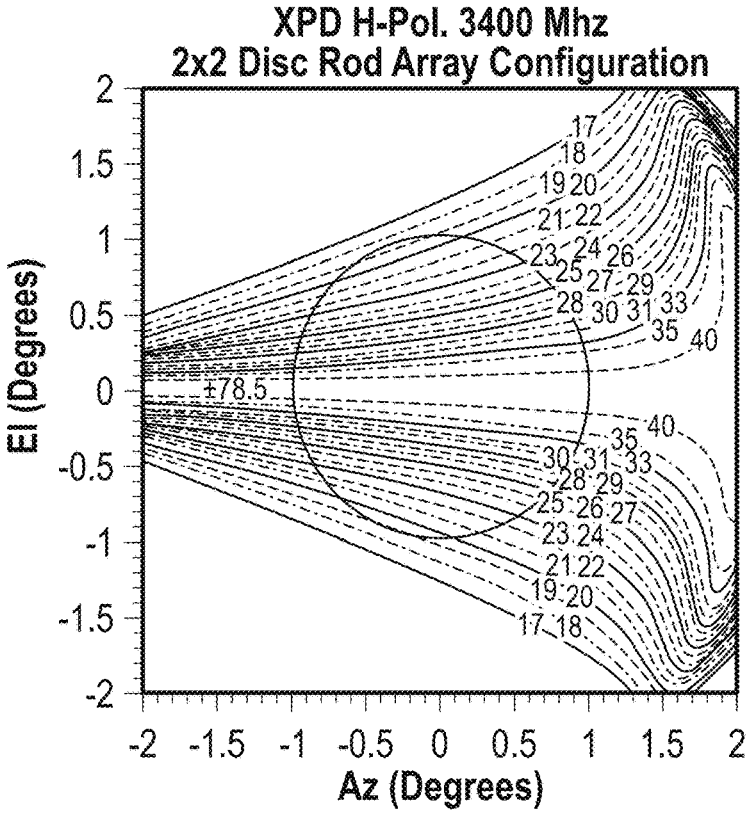
FIG. 14 illustrates cross polarization discrimination in the far field before cross-polarization compensation for horizontal linear polarization.
Figure 15:
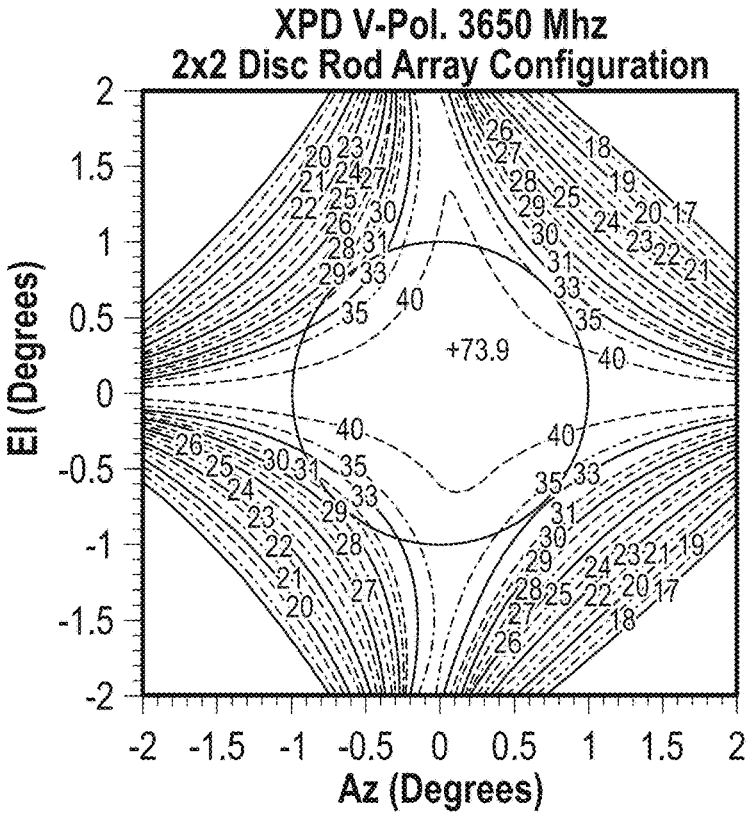
FIG. 15 illustrates cross polarization discrimination in the far field after cross-polarization compensation for horizontal linear polarization.
Figure 16:
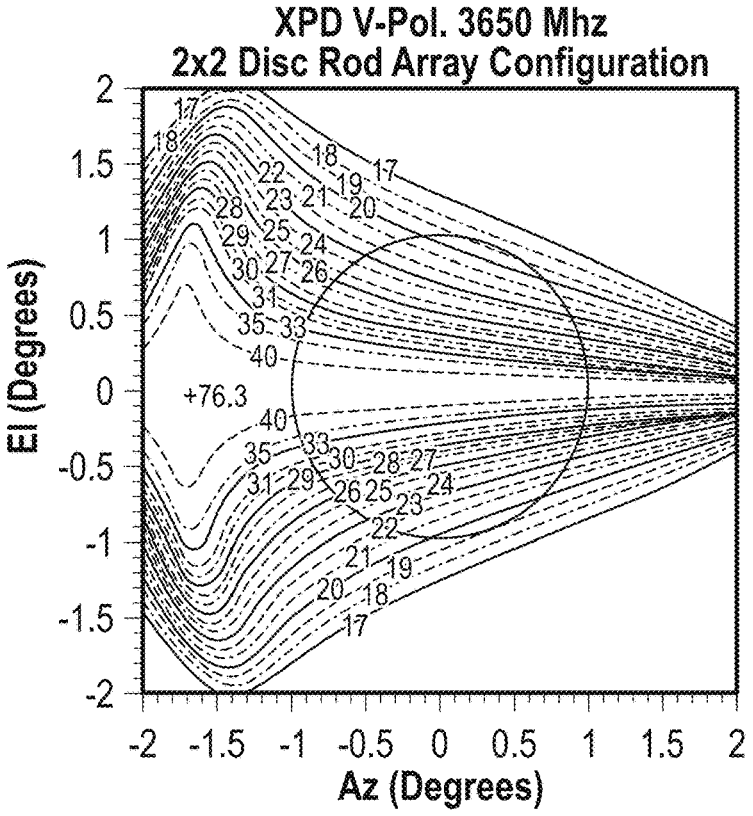
FIG. 16 illustrates cross polarization discrimination in the far field before cross-polarization compensation for horizontal linear polarization.

FIGS. 12A-12D illustrates an example of the co-polarization and cross polarization performance of an embodiment of the reflector antenna at 3.4 GHz (C-band). FIG. 13 illustrates an example of the cross polarization discrimination performance of an embodiment of the reflector antenna at 3.4 GHz prior to configuring the coupling parameters or factors. FIG. 14 illustrates an example of the cross polarization discrimination performance of an embodiment of the reflector antenna at 3.4 GHz after configuring the coupling parameters or factors. FIG. 15 illustrates an example of the cross polarization discrimination performance of an embodiment of the reflector antenna at 3.65 GHz prior to configuring the coupling parameters or factors. FIG. 15 illustrates an example of the cross polarization discrimination performance of an embodiment of the reflector antenna at 3.65 GHz after configuring the coupling parameters or factors.

As illustrated, and shown in the tables below, embodiments of the reflector antenna allow for improved cross polarization discrimination.

| Transmission Performance | | | | | |
|---|---|---|---|---|---|
| Freq MHz | Pol | EOC Peak | X-pol W.C | EOC Min | XPD |
| | | Before Compensation | | | |
| 3400 | h | 36.94 | 18.92 | 34.52 | 18.65 |
| 3650 | h | 37.29 | 19.03 | 34.59 | 17.96 |
| 3400 | v | 36.95 | 19.25 | 34.47 | 19.07 |
| 3650 | v | 37.3 | 19.63 | 34.54 | 18.84 |
| | | After Compensation | | | |
| 3400 | h | 36.886 | 26.42 | 34.36 | 30.37 |
| 3650 | h | 37.269 | 26.8 | 34.45 | 29.87 |
| 3400 | v | 36.957 | 26.59 | 34.45 | 30.31 |
| 3650 | v | 37.327 | 26.608 | 34.48 | 29.98 |

| Receiving Performance | | | | | |
|---|---|---|---|---|---|
| Freq MHz | Pol | EOC Peak | X-pol W.C | EOC Min | XPD |
| | | Before Compensation | | | |
| 6425 | h | 40.272 | 23.78 | 36.31 | 20.73 |
| 6675 | h | 38.52 | 22.41 | 35.32 | 19.81 |
| 6425 | v | 40.267 | 23.94 | 36.37 | 20.49 |
| 6675 | v | 38.56 | 22.96 | 35.21 | 21.97 |
| | | After Compensation | | | |
| 6425 | h | 40.44 | 26.054 | 36.44 | 24.68 |
| 6675 | h | 38.805 | 24.406 | 35.48 | 23.93 |
| 6425 | v | 40.438 | 27.295 | 36.37 | 27.28 |
| 6675 | v | 38.828 | 25.2052 | 35.49 | 26.95 |

In summary, the transmission performance after compensation was improved with ΔAHor=−14.563 dB (0.15 dB transmission co-polarization loss, ΔPHor=85.399 deg and ΔAVer=−13.205 dB (0.21 dB transmission co-polarization loss), ΔPVer=265.935 deg. Similarly receiving performance after compensation was improved with ΔAHor=−27.685 dB (0.007 dB in receiving co-polarization loss), ΔPHor=134.306 deg and ΔAVer=−26.183 dB (0.01 dB in receiving co-polarization loss), ΔPVer=314.505 deg. Further, for transmission bands, cross polarization discrimination performance was improved from 18.0 dB before compensation to 29.9 dB after compensation, while peak gain remained unchanged across the band. Similarly, for receiving bands, cross polarization discrimination performance was improved from 19.8 dB before compensation to 24.0 dB after compensation, while peak gain increased by more than 0.16 dB across the band after compensation.

Advantageously, embodiments of the reflector antennas described herein can be used in applications requiring low cross polarization over broad coverage (e.g. C, Ku, Ka band), allowing long focal distance offset reflector antennas to be replaced by shorter focal distance antennas as described herein. Advantageously, the use of the reflector antennas described herein allow for increased flexibility in spacecraft design as the described antennas may occupy a smaller volume, have a smaller mass, and may be placed on a deck without a tall faring. Further, the described antennas can be utilized for a shaped reflector design for a regional low cross polarization discrimination coverage. Additionally, the dual polarizing elements used within the feed may have lower power handling requirements, as power used is distributed among the array of elements.

As can be appreciated, embodiments of the reflector antenna described herein can utilize a 2×2 array including square tapered waveguides with orthomode transducers configured to illuminate a short focal distance (e.g. F/D=0.53, θ=75.5 deg) single offset reflector. Antennas utilize the arrays described herein can produce peak directivity comparable or favorable to long focal distance single offset reflector antennas (e.g. F/D>=1.4, θ=29.5 deg.) across significant bandwidth (greater than 32%). The antennas described herein can be used with a beamforming network that produces low cross-polarization and/or cross polarization discrimination in far field across a wide frequency band, for example, greater than 32% of bandwidth (e.g. 10.7-14.7 GHz at Ku band).

For example, a reflector antenna in accordance with embodiments described herein can be a Ku-band (10.7 GHz-14.7 GHz) offset reflector antenna. The reflector can have a diameter of 100 inches, a focal length of 53.5 inches, a focal length to diameter ratio of 0.535, and an offset of 36 inches. The feed of the antenna can include an array of square rectangular waveguides with orthomode transducers (OMT) attached thereto. The feed can be a 2×2 array fed by a beamforming network. The array element aperture dimensions can be 0.66 inches by 0.66 inches. The array aperture dimensions can be 1.32 inches by 1.32 inches. The array envelope can be 1.32 inches by 2.16 inches by 3.6 inches including the dual linear OMT. The feed can include eight ports, with four ports transmission/receiving (horizontal polarization) and four ports transmission/receiving (vertical polarization). The feed offset angle can be approximately 75.5 degrees. The reflector illumination cone can be approximately +/−33.5 degrees.

Figure 17:
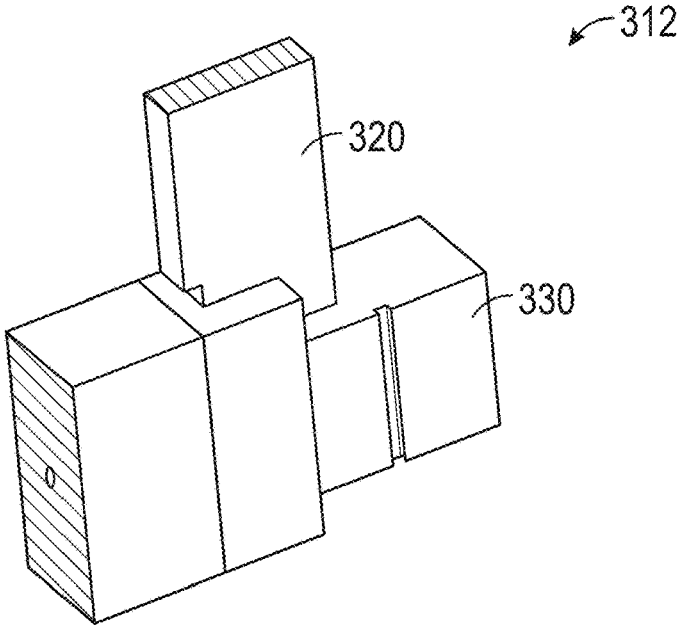
FIGS. 17 and 18 illustrate the square open-ended tapered waveguide with orthomode transducer, according to some embodiments of the present disclosure.
Figure 18:
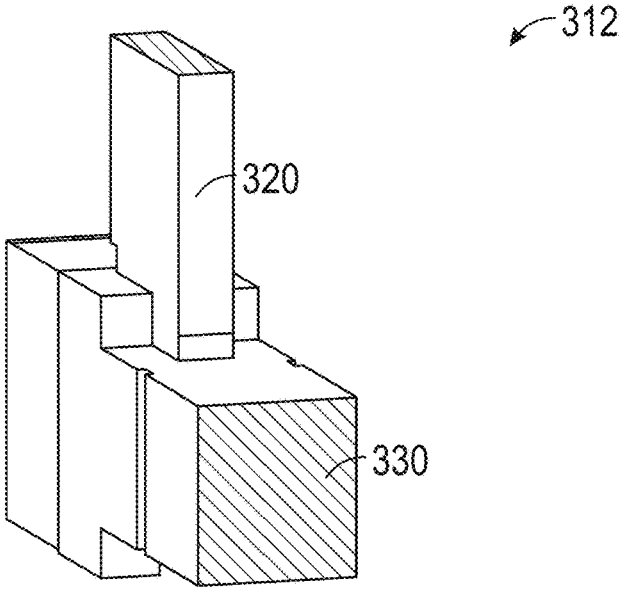

FIGS. 17 and 18 illustrate an element 312, according to some embodiments of the present disclosure. In some applications, the feed of the reflector antennas described herein can utilize elements 312. In the depicted example, the element 312 can include an orthomode transducer 320 and a waveguide 330. As illustrated, the orthomode transducer 320 can have an asymmetric design. As can be appreciated, the orthomode transducer 320 can be scaled for any suitable frequency band.

Figure 19:
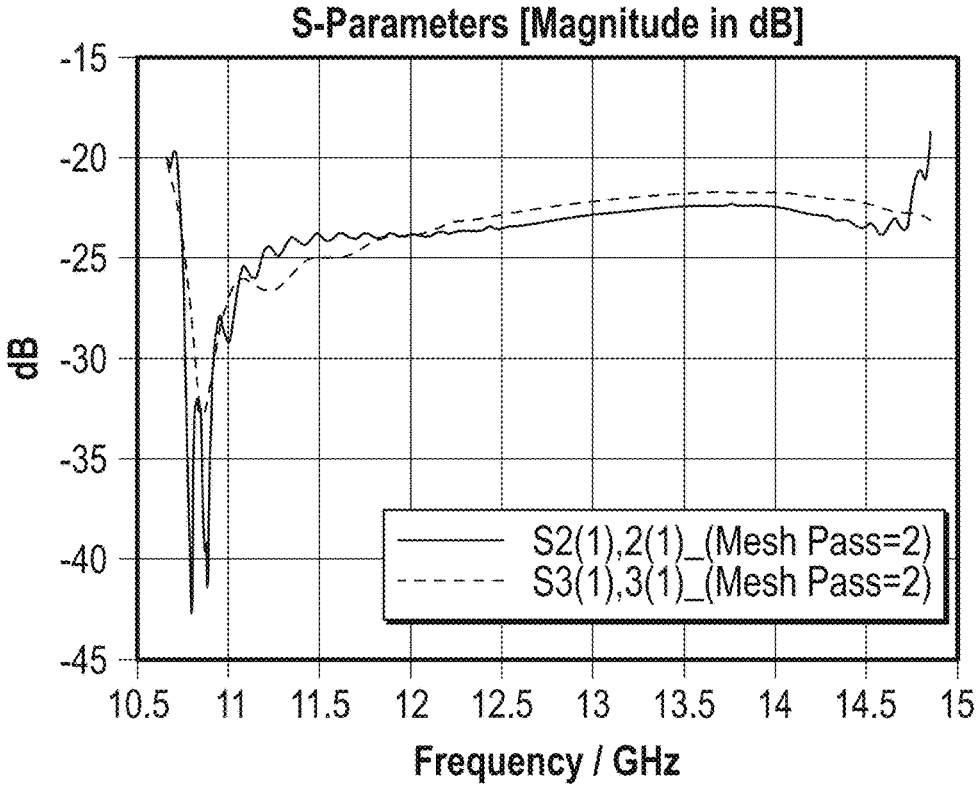
FIGS. 19 and 20 are charts illustrating the $S_{11}$-parameters and insertion loss of the radiating element and orthomode transducer illustrated in FIGS. 17 and 18, according to some embodiments of the present disclosure.
Figure 20:
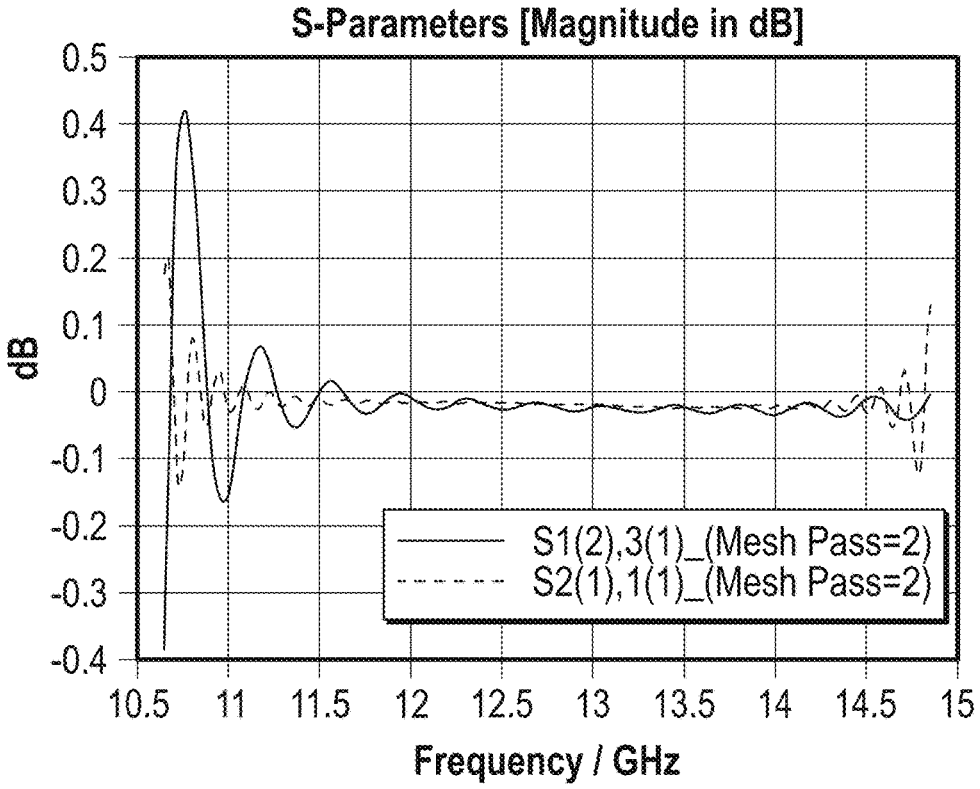

Optionally, the orthomode transducer 320 can be coupled to a waveguide 330. The waveguide 330 can be an open ended waveguide. Further, the cross-sectional profile of the waveguides 330 can be square. In some embodiments, the cross-sectional profile of the waveguides can be tapered. For example, for a Ku-Band application, the orthomode transducer 320 can have an envelope of 0.55 inches wide, 1.0325 inches height, and 1.56 inches length. FIGS. 19 and 20 are charts illustrating the $S_{11}$-parameters and insertion loss of the radiating element and orthomode transducer 320 of FIGS. 17 and 18, according to some embodiments of the present disclosure. With reference to FIGS. 19 and 20, the orthomode transducer 320 allows for improved S-parameters while allowing for a compact envelope.

Figure 21:
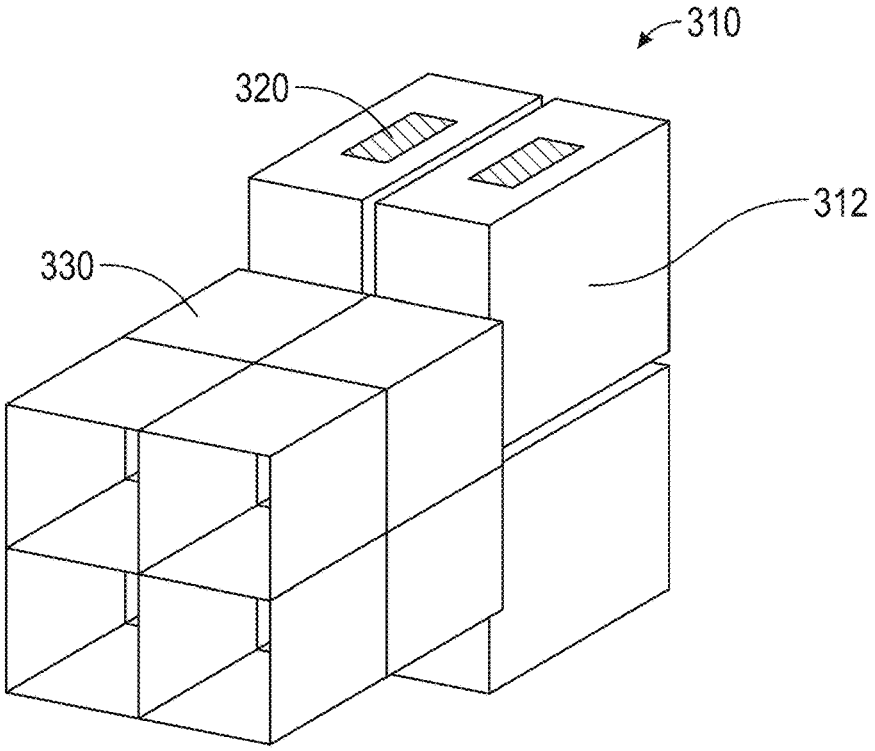
FIGS. 21 and 22 illustrate 2×2 array of square open-ended tapered waveguides and 8 orthomode transducers, 4 for horizontal and 4 for vertical linear polarizations, according to some embodiments of the present disclosure.
Figure 22:
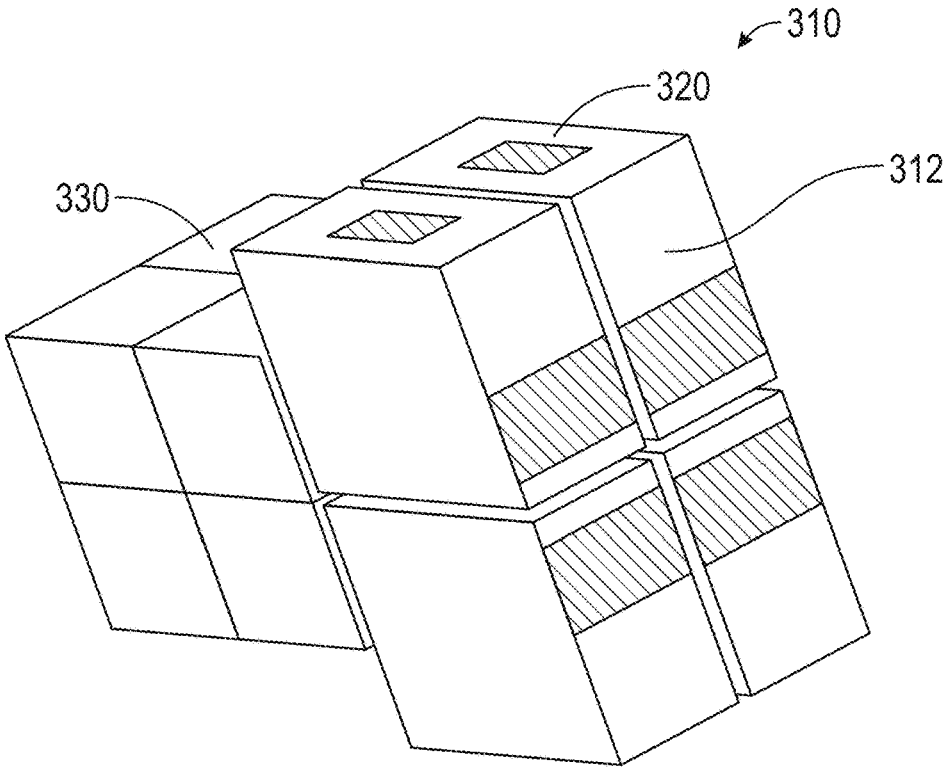

FIGS. 21 and 22 illustrate a feed 310, according to some embodiments of the present disclosure. In the depicted example, multiple elements 312 or orthomode transducers 320 can be arranged in an array to form the feed 310. As illustrated, and described herein, the elements 312 or the orthomode transducers 320 can arranged in a 2×2 array to form the feed 310. In some embodiments, the feed 310 can include 8 orthomode transducers 320. For example, the feed 310 can include 4 orthomode transducers 320 for horizontal linear polarizations and 4 orthomode transducers 320 for vertical linear polarizations.

Figure 23:
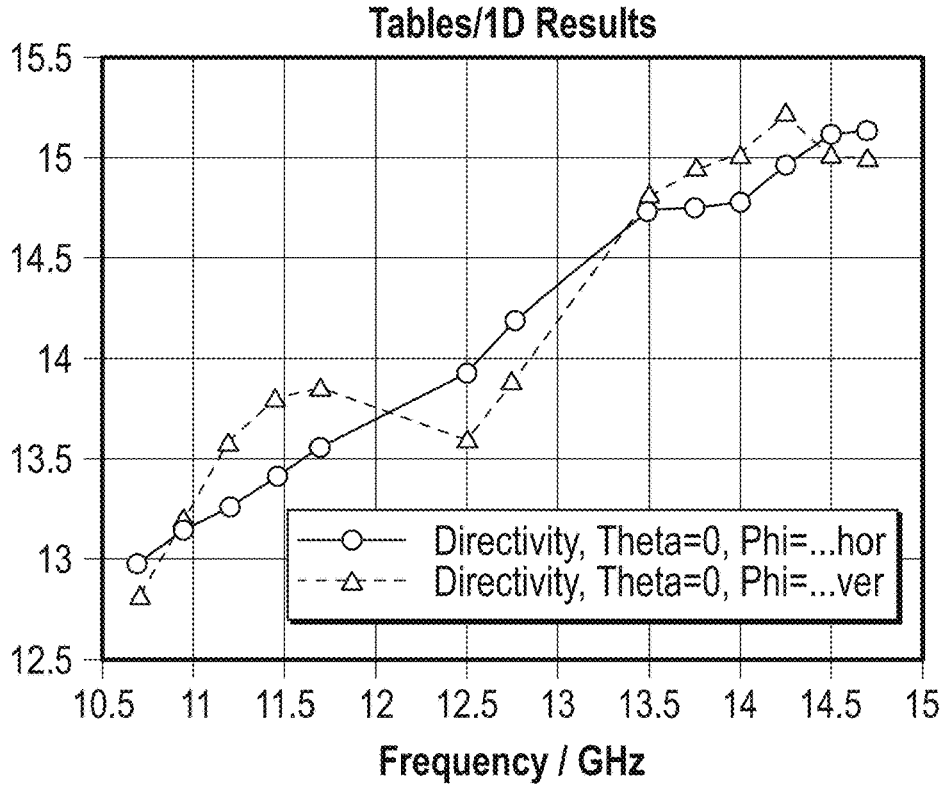
FIG. 23 is a chart illustrating the performance-peak directivity of the reflector antenna fed by the array illustrated in FIGS. 21 and 22 and compared with the directivity of the long focal reflector antenna of the same diameter and fed by a corrugated high gain horn.
Figure 24:
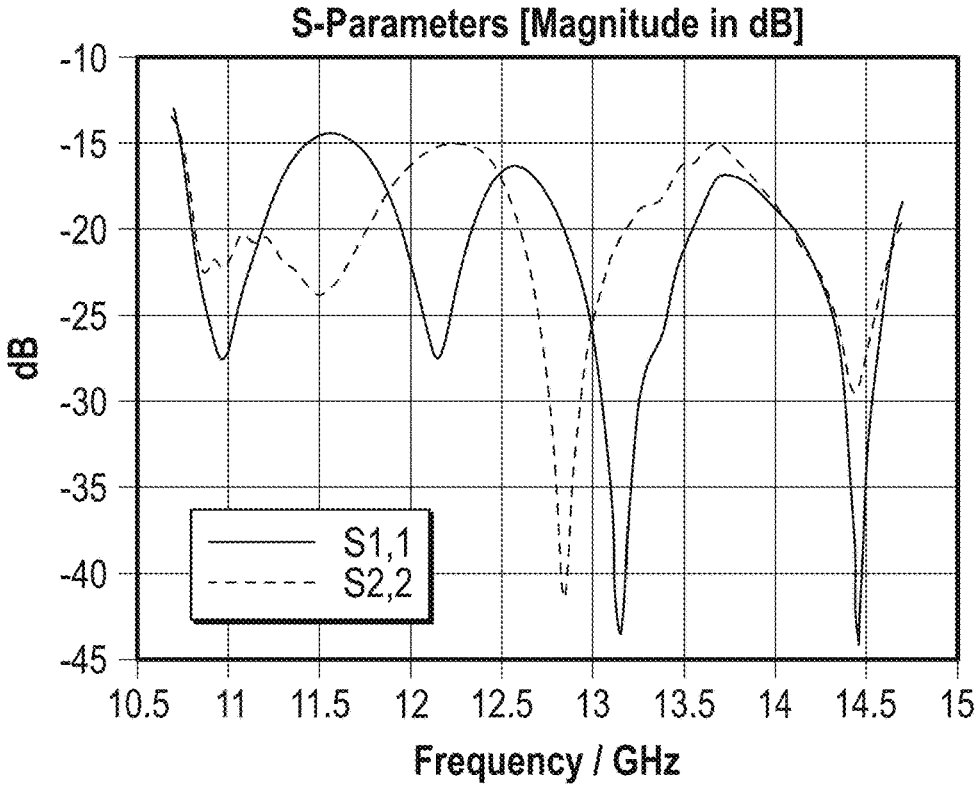
FIG. 24 is the chart illustrating the $S_{11}$-parameters for the vertical and horizontal polarization of the array illustrated in FIGS. 17 and 18, according to some embodiments of the present disclosure.

FIGS. 23 and 24 are charts illustrating the directivity and the S-parameters of the feed 310 of FIGS. 21 and 22, according to some embodiments of the present disclosure. With reference to FIGS. 23 and 24, the feed 310 allows for improved S-parameters for vertical and horizontal polarizations while allowing for a compact envelope compared to conventional antennas. As can be appreciated, as the ground plane is moved closer to the aperture the performance of the feed 310 can be improved by further reducing the difference between the vertical and horizontal polarization directivities.

Figure 25:
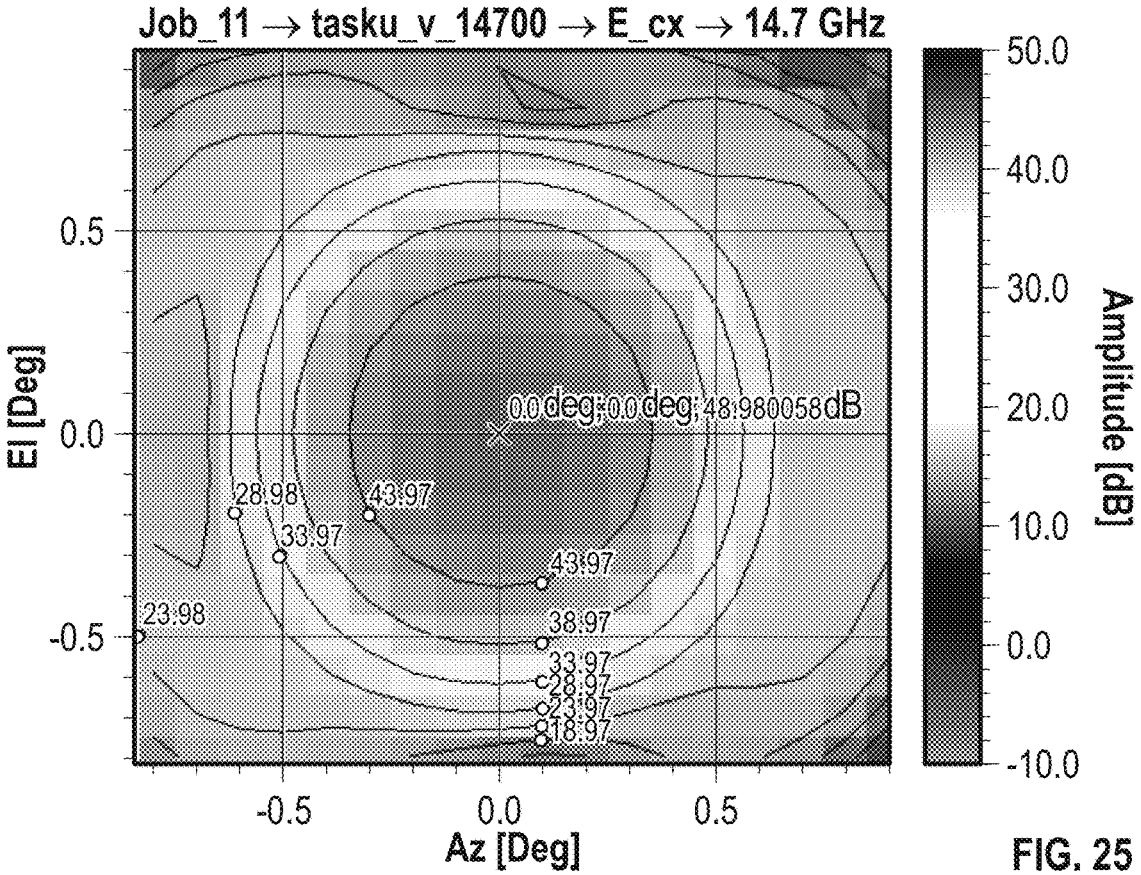
FIGS. 25 and 26 are charts illustrating the Sigma and Delta far field patterns of the reflector antenna fed by the array illustrated on FIGS. 17 and 18 before applying cross-polarization compensations, according to some embodiments of the present disclosure.
Figure 26:
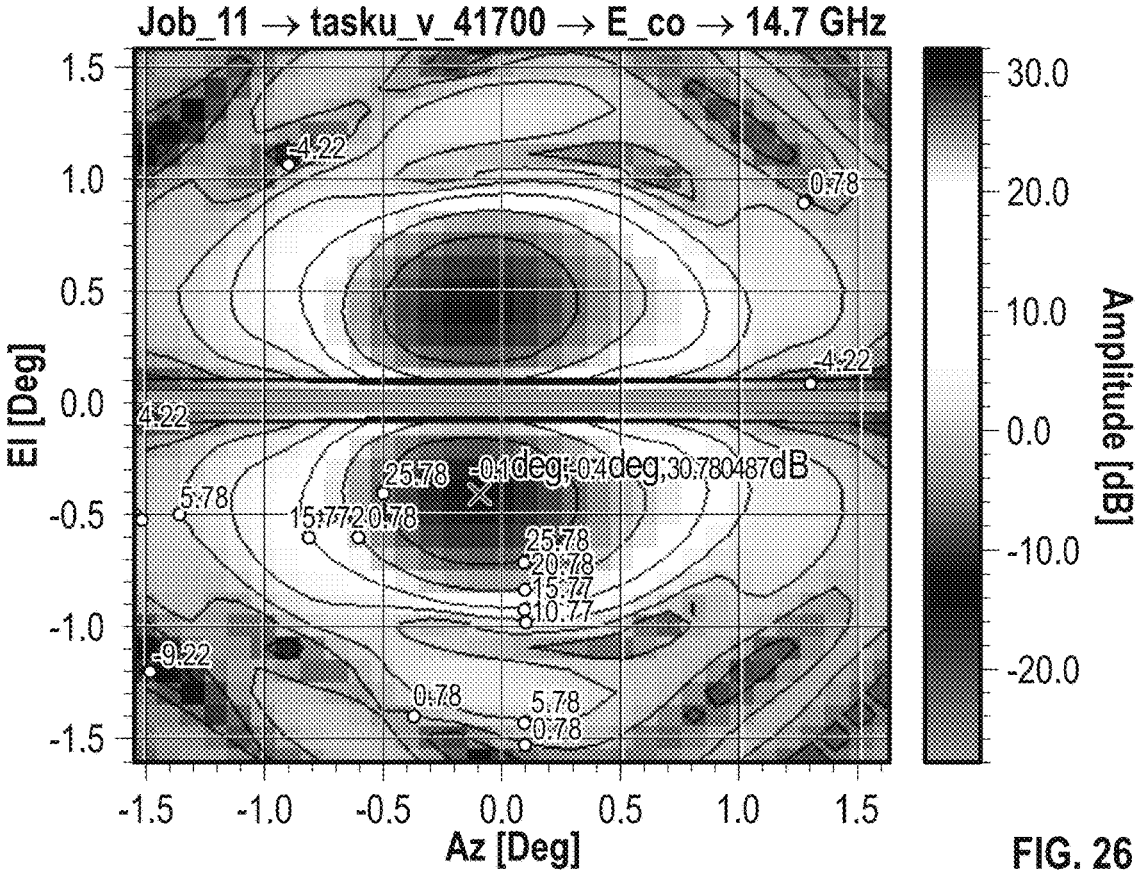

FIGS. 25 and 26 are example plots of the sigma and delta co-polarization patterns produced by a reflector illuminated by the feed 310 prior to applying cross-polarization compensations.

Figure 27:
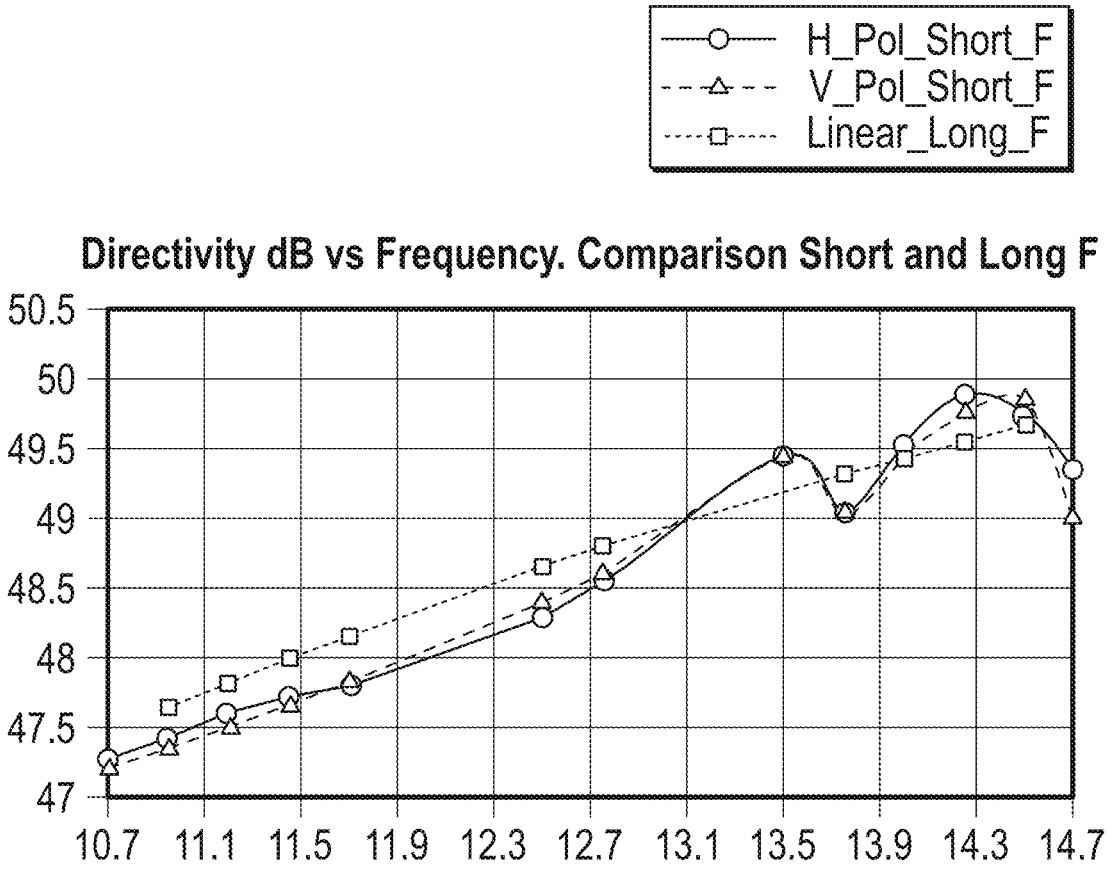
FIG. 27 is a chart illustrating the performance-peak directivity of the reflector antenna fed by the array illustrated in FIGS. 21 and 22 and compared with the directivity of the long focal reflector antenna of the same diameter and fed by a corrugated high gain horn.

FIG. 27 illustrates directivity of an antenna utilizing the feed 310 with a short focal length compared to a conventional long focal reflector antenna of the same diameter and fed by a corrugated high gain horn. As illustrated, and shown in the table below, the peak directivity of the reflector antenna utilizing the feed 310 is within −0.35/+0.33 dB of the directivity of the long focal length antenna across the Ku Band.

| Freq | H_Short | V_Short | H, V_Long | H_diff | V_diff | dif. w.c. | dif_AV |
|---|---|---|---|---|---|---|---|
| 10.7 | 47.26 | 47.21 | | | | | |
| 10.95 | 47.43 | 47.35 | 47.64 | −0.21 | −0.29 | −0.29 | −0.25 |
| 11.2 | 47.6 | 47.51 | 47.82 | −0.22 | −0.31 | −0.31 | −0.265 |
| 11.45 | 47.71 | 47.67 | 47.99 | −0.28 | −0.32 | −0.32 | −0.3 |
| 11.7 | 47.81 | 47.83 | 48.16 | −0.35 | −0.33 | −0.35 | −0.34 |
| 12.5 | 48.3 | 48.4 | 48.66 | −0.36 | −0.26 | −0.36 | −0.31 |
| 12.75 | 48.56 | 48.61 | 48.81 | −0.25 | −0.2 | −0.25 | −0.225 |
| 13.5 | 49.45 | 49.44 | | | | | |
| 13.75 | 49.05 | 49.03 | 49.32 | −0.27 | −0.29 | −0.27 | −0.28 |
| 14 | 49.53 | 49.46 | 49.44 | 0.09 | 0.02 | 0.09 | 0.055 |
| 14.25 | 49.89 | 49.76 | 49.56 | 0.33 | 0.2 | 0.33 | 0.265 |
| 14.5 | 49.77 | 49.85 | 49.68 | 0.09 | 0.17 | 0.17 | 0.13 |
| 14.7 | 49.33 | 48.98 | | | | | |

Advantageously, the embodiments described herein can maximize cross polarization discrimination in far field, as described in the tables below.

| Uncompensated | | | | |
|---|---|---|---|---|
| Freq GHz | Pol | Peak dBi | Xpl dBi | X-pol W.C. dB |
| 10.7 | H | 47.26 | 30.401 | 16.859 |
| 11.2 | H | 47.6 | 30.578 | 17.022 |
| 11.7 | H | 47.81 | 31.024 | 16.786 |
| 12.75 | H | 48.56 | 31.635 | 16.925 |
| 13.5 | H | 49.45 | 31.983 | 17.467 |
| 14.25 | H | 49.89 | 32.28 | 17.61 |
| 14.7 | H | 49.33 | 31.958 | 17.372 |
| 10.7 | V | 47.21 | 30.582 | 16.628 |
| 11.2 | V | 47.51 | 30.388 | 17.122 |
| 11.7 | V | 47.83 | 30.367 | 17.463 |
| 12.75 | V | 48.61 | 31.321 | 17.289 |
| 13.5 | V | 49.44 | 32.285 | 17.155 |
| 14.25 | V | 49.76 | 32.063 | 17.697 |
| 14.7 | V | 48.98 | 30.78 | 18.2 |

| Compensated | | | | | |
|---|---|---|---|---|---|
| Freq GHz | Pol | Peak dBi | Xpl dBi | X-pol W.C. dB | Diff_Dir |
| 10.7 | H | 47.289 | 21.797 | 25.492 | 0.0293 |
| 11.2 | H | 47.653 | 21.009 | 26.644 | 0.0534 |
| 11.7 | H | 47.876 | 21.979 | 25.897 | 0.0656 |
| 12.75 | H | 48.642 | 21.976 | 26.665 | 0.0816 |
| 13.5 | H | 49.55 | 17.253 | 32.297 | 0.0998 |
| 14.25 | H | 50.012 | 16.357 | 33.655 | 0.1218 |
| 14.7 | H | 49.477 | 21.977 | 27.5 | 0.1468 |
| 10.7 | V | 47.212 | 21.262 | 25.95 | 0.0018 |
| 11.2 | V | 47.536 | 18.349 | 29.187 | 0.0262 |
| 11.7 | V | 47.869 | 18.191 | 29.678 | 0.0389 |
| 12.75 | V | 48.66 | 17.665 | 30.996 | 0.0504 |
| 13.5 | V | 49.504 | 17.319 | 32.185 | 0.0644 |
| 14.25 | V | 49.867 | 18.768 | 31.098 | 0.1065 |
| 14.7 | V | 49.108 | 22.684 | 26.424 | 0.1281 |

| Coupling | | | | | |
|---|---|---|---|---|---|
| Freq GHz | Pol | Real | Image | dB | deg |
| 10.7 | H | 0.1017 | −0.19 | −13.33 | −61.84 |
| 11.2 | H | 0.1017 | −0.19 | −13.33 | −61.84 |
| 11.7 | H | 0.1017 | −0.19 | −13.33 | −61.84 |
| 12.75 | H | 0.1017 | −0.19 | −13.33 | −61.84 |
| 13.5 | H | 0.1017 | −0.19 | −13.33 | −61.84 |
| 14.25 | H | 0.1017 | −0.19 | −13.33 | −61.84 |
| 14.7 | H | 0.1017 | −0.19 | −13.33 | −61.84 |
| 10.7 | V | 0.0845 | 0.2273 | −12.31 | 69.602 |
| 11.2 | V | 0.0845 | 0.2273 | −12.31 | 69.602 |
| 11.7 | V | 0.0845 | 0.2273 | −12.31 | 69.602 |
| 12.75 | V | 0.0845 | 0.2273 | −12.31 | 69.602 |
| 13.5 | V | 0.0845 | 0.2273 | −12.31 | 69.602 |
| 14.25 | V | 0.0845 | 0.2273 | −12.31 | 69.602 |
| 14.7 | V | 0.0845 | 0.2273 | −12.31 | 69.602 |

Further, cross polarization discrimination can be maximized in far field within a circle of 0.35 degrees, as shown in the tables below.

| Uncompensated | | | | | |
|---|---|---|---|---|---|
| Freq GHz | Pol | Peak dBi | Xpl dBi | X-pol W.C. dB | XPD @0.35 deg rad, dB |
| 10.7 | H | 47.26 | 30.401 | 16.859 | 16.1331 |
| 11.2 | H | 47.6 | 30.578 | 17.022 | 15.733 |

-continued

Uncompensated

| Freq GHz | Pol | Peak dBi | Xpl dBi | X-pol W.C. dB | XPD @0.35 deg rad, dB |
|---|---|---|---|---|---|
| 11.7 | H | 47.81 | 31.024 | 16.786 | 15.122 |
| 12.75 | H | 48.56 | 31.635 | 16.925 | 14.6188 |
| 13.5 | H | 49.45 | 31.983 | 17.467 | 14.7212 |
| 14.25 | H | 49.89 | 32.28 | 17.61 | 14.71 |
| 14.7 | H | 49.33 | 31.958 | 17.372 | 13.8958 |
| 10.7 | V | 47.21 | 30.582 | 16.628 | 16.0561 |
| 11.2 | V | 47.51 | 30.388 | 17.122 | 16.332 |
| 11.7 | V | 47.83 | 30.367 | 17.463 | 16.5123 |
| 12.75 | V | 48.61 | 31.321 | 17.289 | 15.2216 |
| 13.5 | V | 49.44 | 32.285 | 17.155 | 14.375 |
| 14.25 | V | 49.76 | 32.063 | 17.697 | 14.7494 |
| 14.7 | V | 48.98 | 30.78 | 18.2 | 15.7122 |

Compensated

| Freq GHz | Pol | Peak dBi | Xpl dBi | X-pol W.C. dB | XPD @0.35 deg rad, dB | Diff_Dir |
|---|---|---|---|---|---|---|
| 10.7 | H | 47.268 | 20.141 | 27.128 | 26.1105 | 0.0083 |
| 11.2 | H | 47.636 | 18.798 | 28.838 | 27.7241 | 0.0356 |
| 11.7 | H | 47.86 | 20.523 | 27.337 | 26.8257 | 0.0495 |
| 12.75 | H | 48.623 | 22.603 | 26.02 | 26.0708 | 0.0634 |
| 13.5 | H | 49.536 | 15.29 | 34.246 | 36.2753 | 0.0863 |
| 14.25 | H | 50.001 | 15.176 | 34.825 | 37.2007 | 0.1108 |
| 14.7 | H | 49.47 | 22.208 | 27.262 | 2.1492 | 0.14 |
| 10.7 | V | 47.233 | 21.503 | 25.73 | 25.2327 | 0.0228 |
| 11.2 | V | 47.551 | 19.842 | 27.71 | 27.7744 | 0.0412 |
| 11.7 | V | 47.882 | 19.813 | 28.069 | 29.7654 | 0.0516 |
| 12.75 | V | 48.676 | 18.875 | 29.801 | 28.3998 | 0.0659 |
| 13.5 | V | 49.518 | 19.217 | 30.301 | 29.0068 | 0.0783 |
| 14.25 | V | 49.88 | 16.894 | 32.986 | 35.1178 | 0.1203 |
| 14.7 | V | 49.123 | 22.771 | 26.352 | 25.2298 | 0.1427 |

Coupling

| Freq GHz | Pol | Real | Image | dB | deg |
|---|---|---|---|---|---|
| 10.7 | H | 0.1244 | −0.203 | −12.45 | −58.55 |
| 11.2 | H | 0.1244 | −0.203 | −12.45 | −58.55 |
| 11.7 | H | 0.1244 | −0.203 | −12.45 | −58.55 |
| 12.75 | H | 0.1244 | −0.203 | −12.45 | −58.55 |
| 13.5 | H | 0.1244 | −0.203 | −12.45 | −58.55 |
| 14.25 | H | 0.1244 | −0.203 | −12.45 | −58.55 |
| 14.7 | H | 0.1244 | −0.203 | −12.45 | −58.55 |
| 10.7 | V | 0.1133 | 0.1946 | −12.95 | 59.791 |
| 11.2 | V | 0.1133 | 0.1946 | −12.95 | 59.791 |
| 11.7 | V | 0.1133 | 0.1946 | −12.95 | 59.791 |
| 12.75 | V | 0.1133 | 0.1946 | −12.95 | 59.791 |
| 13.5 | V | 0.1133 | 0.1946 | −12.95 | 59.791 |
| 14.25 | V | 0.1133 | 0.1946 | −12.95 | 59.791 |
| 14.7 | V | 0.1133 | 0.1946 | −12.95 | 59.791 |

As can be appreciated, the antenna illuminated by the arrays described herein can be scaled in dimensions within the same frequency band (maintaining the focal distance ratio or F/D, the feed offset angle and/or offset/diameter). Advantageously, the frequency of the antenna can be scaled or changed without effecting or changing the broadband cross-polarization performance achieved with the power decoupling factor, as presented in the above tables.

Terms such as "top," "bottom," "front," "rear", "above", and "below" and the like as used in this disclosure should be understood as referring to an arbitrary frame of reference, rather than to the ordinary gravitational frame of reference. Thus, a top surface, a bottom surface, a front surface, and a rear surface may extend upwardly, downwardly, diagonally, or horizontally in a gravitational frame of reference.

A phrase such as an "aspect" does not imply that such aspect is essential to the subject technology or that such aspect applies to all configurations of the subject technology. A disclosure relating to an aspect may apply to all configurations, or one or more configurations. A phrase such as an aspect may refer to one or more aspects and vice versa. A phrase such as an "embodiment" does not imply that such embodiment is essential to the subject technology or that such embodiment applies to all configurations of the subject technology. A disclosure relating to an embodiment may apply to all embodiments, or one or more embodiments. A phrase such an embodiment may refer to one or more embodiments and vice versa.

The word "exemplary" is used herein to mean "serving as an example or illustration." Any aspect or design described herein as "exemplary" is not necessarily to be construed as preferred or advantageous over other aspects or designs.

All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. § 112, sixth paragraph, unless the element is expressly recited using the phrase "means for" or, in the case of a method claim, the element is recited using the phrase "step for." Furthermore, to the extent that the term "include," "have," or the like is used in the description or the claims, such term is intended to be inclusive in a manner similar to the term "comprise" as "comprise" is interpreted when employed as a transitional word in a claim.

What is claimed is:

1. A reflector antenna comprising:

a reflector having a reflector plane of symmetry;

a feed spaced apart at a focal distance from the reflector, the feed comprising an array of dual linear polarized elements; and a beamforming network operatively coupled to the feed and configured to generate a Sigma pattern and a Delta pattern in a plane orthogonal to the reflector plane of symmetry, wherein the Delta pattern is excited by power decoupled from the Sigma pattern.

2. The reflector antenna of claim 1, wherein the reflector has a diameter and a ratio of the focal distance to the diameter is less than 0.55.

3. The reflector antenna of claim 1, wherein the beamforming network is configured to generate the Sigma pattern and the Delta pattern in orthogonal polarizations.

4. The reflector antenna of claim 1, wherein the Delta pattern is normalized to a cross-polarization of the Sigma pattern.

5. The reflector antenna of claim 4, wherein the Delta pattern is out of phase to the cross-polarization of the Sigma pattern.

6. The reflector antenna of claim 5, wherein the Delta pattern is out of phase to the cross-polarization of the Sigma pattern across at least 50% of a bandwidth of the reflector antenna.

7. The reflector antenna of claim 5, wherein a power decoupling factor is maintained across at least 50% of a bandwidth.

8. The reflector antenna of claim 1, wherein the array of dual linear polarized elements each comprise an orthomode transducer.

9. The reflector antenna of claim 8, wherein the orthomode transducer is asymmetric.

10. The reflector antenna of claim 1, wherein the array of dual linear polarized elements each comprise an open ended waveguide.

11. The reflector antenna of claim 10, wherein the open ended waveguide is tapered.

12. The reflector antenna of claim 10, wherein the open ended waveguide has a square cross-sectional shape.

13. A feed for use with a reflector antenna, the feed comprising:

an array of dual linear polarized orthomode transducers, wherein the array comprises an orthomode transducer that includes an asymmetric shape; and an open ended waveguide, wherein each dual linear polarized orthomode transducer is coupled to the open ended waveguide.

14. The feed of claim 13, wherein the open ended waveguide is tapered.

15. The feed of claim 13, wherein the open ended waveguide has a square cross-sectional shape.

16. A reflector antenna comprising:

a reflector; and an array of dual linear polarized orthomode transducers spaced apart from the reflector, wherein each dual linear polarized orthomode transducer is coupled to an open ended waveguide, and at least one orthomode transducer of the dual linear polarized orthomode transducers comprises an asymmetric shape.

17. The reflector antenna of claim 5, wherein the reflector has a diameter, the array of dual linear polarized orthomode transducers is spaced apart a focal distance from the reflector, and a ratio of the focal distance to the diameter is less than 0.55.

18. The reflector antenna of claim 5, wherein the open ended waveguide is tapered.

19. The reflector antenna of claim 5, wherein the open ended waveguide has a square cross-sectional shape.

* * * * *